US009567701B2

(12) United States Patent
Lee et al.

(10) Patent No.: US 9,567,701 B2
(45) **Date of Patent: *Feb. 14, 2017**

(54) LAUNDRY TREATING APPARATUS

(71) Applicant: LG ELECTRONICS INC., Seoul (KR)

(72) Inventors: Aram Lee, Seoul (KR); Soojin Kim, Seoul (KR); Yongjun An, Seoul (KR); Soowon Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 14 days.

This patent is subject to a terminal disclaimer.

(21) Appl. No.: 14/619,526

(22) Filed: Feb. 11, 2015

(65) Prior Publication Data

US 2015/0233038 A1 Aug. 20, 2015

(30) Foreign Application Priority Data

Feb. 18, 2014 (KR) ..... 10-2014-0018413

(51) Int. Cl.

| | |
|---|---|
| ***A47B 95/02*** | (2006.01) |
| ***D06F 37/22*** | (2006.01) |
| ***D06F 39/14*** | (2006.01) |
| ***D06F 37/26*** | (2006.01) |

(52) U.S. Cl.

CPC ..... *D06F 37/225* (2013.01); *D06F 37/268* (2013.01); *D06F 39/14* (2013.01)

(58) Field of Classification Search

CPC ..... Y10T 16/5383; Y10T 16/625; F16F 1/128; F16F 9/54; F16F 13/005

USPC ..... 312/319.1

See application file for complete search history.

(56) References Cited

U.S. PATENT DOCUMENTS

| | | | | |
|---|---|---|---|---|
| 2,487,745 | A * | 11/1949 | Witmer | E05B 83/36 16/292 |
| 2,982,540 | A | 5/1961 | Eppley et al. | |
| 3,018,508 | A | 1/1962 | Keeling, Sr. | |
| 3,018,509 | A | 1/1962 | Sherman | |

(Continued)

FOREIGN PATENT DOCUMENTS

| | | |
|---|---|---|
| AU | 2011345515 | 6/2012 |
| CN | 103225194 | 7/2013 |

(Continued)

OTHER PUBLICATIONS

European Search Report dated May 15, 2015 issued in Application No. 15154937.5.

(Continued)

*Primary Examiner* — Matthew Ing

(74) *Attorney, Agent, or Firm* — Ked & Associates, LLP

(57) ABSTRACT

The laundry treating apparatus includes a door to open and close the introduction port about a first rotational or a second rotational axis which is different from first rotational axis. A first switching unit is provided in the door to allow rotation of door about the first rotational axis, and a second switching unit is provided in the door to allow rotation of the door about the second rotational axis. A lock fixes a position of at least one of the first switching unit or second switching unit when the door opens the introduction port. A damper is also provided. As can be appreciated, the mechanism used for the laundry apparatus may be applicable to other home appliances or non-home appliances where two different rotational axes may be needed to open and close a door.

9 Claims, 15 Drawing Sheets

(56) References Cited

U.S. PATENT DOCUMENTS

| | | | | |
|---|---|---|---|---|
| 3,030,656 | A | 4/1962 | Hopkins | |
| 3,538,641 | A | 11/1970 | Miller et al. | |
| 3,802,124 | A | 4/1974 | Guerrini | |
| 3,909,877 | A * | 10/1975 | Christy | E05F 3/221 16/49 |
| 4,035,953 | A | 7/1977 | Bierlich | |
| 4,445,717 | A | 5/1984 | Imhoff | |
| 4,532,673 | A | 8/1985 | Kim | |
| 5,829,197 | A | 11/1998 | Oh | |
| 7,243,973 | B2 | 7/2007 | Plett et al. | |
| 7,481,479 | B1 | 1/2009 | Townson et al. | |
| 7,547,056 | B2 | 6/2009 | Waldner et al. | |
| 9,371,608 | B2 | 6/2016 | Cho et al. | |
| 9,435,068 | B2 | 9/2016 | Kang et al. | |
| 2006/0123855 | A1 | 6/2006 | Erickson | |
| 2008/0109987 | A1 * | 5/2008 | Chen | E05F 5/10 16/68 |
| 2010/0175221 | A1 | 7/2010 | Klassen et al. | |
| 2010/0295428 | A1 | 11/2010 | Favaro et al. | |
| 2012/0161594 | A1 * | 6/2012 | Kim | D06F 39/14 312/228 |
| 2012/0187811 | A1 | 7/2012 | Kim et al. | |
| 2012/0217851 | A1 | 8/2012 | Bae et al. | |
| 2013/0193823 | A1 | 8/2013 | Cho et al. | |

FOREIGN PATENT DOCUMENTS

| | | | |
|---|---|---|---|
| CN | 103314151 | | 9/2013 |
| CN | 204825396 | | 12/2015 |
| CN | 204825403 | | 12/2015 |
| EP | 2 620 538 | A2 | 7/2013 |
| EP | 2 657 393 | A2 | 10/2013 |
| EP | 2 907 910 | A1 | 8/2015 |
| JP | S48-074044 | | 10/1973 |
| JP | S64-043182 | U | 3/1989 |
| JP | H08-164294 | | 6/1996 |
| JP | H08-270308 | A | 10/1996 |
| JP | 2007-329241 | A | 12/2007 |
| JP | 4668848 | | 4/2011 |
| JP | 2013-203168 | | 10/2013 |
| JP | 2014-501141 | A | 1/2014 |
| JP | 2014-504194 | | 2/2014 |
| KR | 10-2012-0134367 | | 12/2012 |
| KR | 10-2013-0071844 | A | 7/2013 |
| WO | WO 2012/087055 | A2 | 6/2012 |

OTHER PUBLICATIONS

European Search Report dated May 15, 2015 issued in Application No. 15154939.1.
European Search Report dated May 15, 2015 issued in Application No. 15154938.3.
European Search Report dated Nov. 17, 2015 issued in Application No. 15184030.3.
United States Office Action dated Feb. 3, 2016 issued in U.S. Appl. No. 14/619,459.
United States Office Action dated Feb. 9, 2016 issued in U.S. Appl. No. 14/619,638.
Australian Office Action dated Mar. 11, 2016 issued in Application No. 2015227451.
U.S. Office Action dated May 23, 2016 issued in co-pending U.S. Appl. No. 14/619,638.
Chinese Office Action dated Jul. 28, 2016 issued in Application No. 201510076064.4 (with English translation).
Chinese Office Action dated Jul. 28, 2016 issued in Application No. 201510076081.8 (with English translation).
United States Office Action dated Aug. 8, 2016 issued in U.S. Appl. No. 15/231,336.
United States Office Action dated Aug. 30, 2016 issued in U.S. Appl. No. 14/619,638.
Australian Office Action dated May 5, 2016 issued in Application No. 2015227423.
Korean Notice of Allowance dated Jun. 30, 2016 issued in Application No. 10-2014-0123879.
U.S. Appl. No. 14/619,459, filed Feb. 11, 2015, Matthew W. Ing.
U.S. Appl. No. 14/619,638, filed Feb. 11, 2015, Matthew W. Ing.
U.S. Appl. No. 14/857,571, filed Sep. 17, 2015, Timothy Michael Ayres.
U.S. Appl. No. 14/857,608, filed Sep. 17, 2015, Hanh Van Tran.
U.S. Office Action dated Oct. 6, 2016 issued in U.S. Appl. No. 14/857,608.
U.S. Final Office Action dated Dec. 20, 2016 issued in co-pending U.S. Appl. No. 14/619,638.

* cited by examiner (a)

(b)

(a)

(b)

(a)

(b)

(a)

(b)

(a)

(b)

LAUNDRY TREATING APPARATUS

CROSS-REFERENCE TO RELATED APPLICATION

This application claims priority under 35 U.S.C. §119 to Korean Application No. 10-2014-0018413 filed on Feb. 18, 2014, whose entire disclosure is incorporated herein by reference.

BACKGROUND

1. Field

The present disclosure relates to a laundry treating apparatus.

2. Background

In general, a laundry treating apparatus is a generic name of home appliances that are capable of washing, drying, or washing and drying laundry. The laundry treating apparatus removes contaminants from laundry through action of water and detergent to wash the laundry. On the other hand, the laundry treating apparatus removes moisture from laundry through a heated air supply device provided in the laundry treating apparatus to dry the laundry.

A laundry treating apparatus generally comprises a cabinet forming the external appearance thereof, a laundry receiving space provided in the cabinet to receive laundry, an introduction port provided at the cabinet such that the introduction port communicates with the laundry receiving space, and a door to open and close the introduction port. The door is generally configured to rotate about one vertical axis defined in a height direction of the cabinet.

BRIEF DESCRIPTION OF THE DRAWINGS

The embodiments will be described in detail with reference to the following drawings in which like reference numerals refer to like elements wherein.

DETAILED DESCRIPTION

Figure 1:
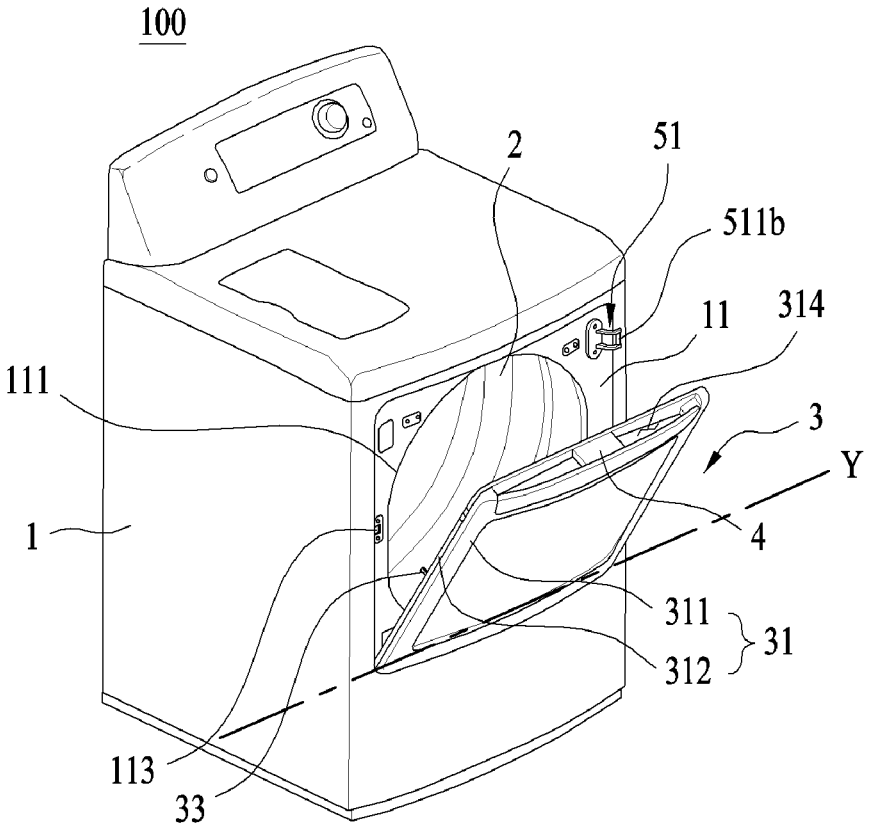
FIGS. 1 and 3 are perspective views showing a laundry treating apparatus according to an embodiment of the present disclosure.

As shown in FIG. 1, a laundry treating apparatus 100 includes a cabinet 1 forming the external appearance thereof, a laundry receiving unit 2 provided in the cabinet 1 to provide a space to receive laundry, and a door 3 provided at the cabinet 1 to open and close the laundry receiving unit 2. The cabinet 1 includes a front panel 11 having an introduction port 111. The door 3 is provided at the front panel 11 to open and close the introduction port 111. A user may open the introduction port 111 through the door 3 to introduce laundry (laundry to be washed or laundry to be dried) into the laundry receiving unit 2 or remove the laundry from the laundry receiving unit 2.

In a case in which the laundry treating apparatus 100 is a laundry washing machine, the laundry receiving unit 2 may include a tub provided in the cabinet 1 to store wash water and a drum rotatably provided in the tub to provide a space to receive laundry. In this case, the tub may have a tub introduction port communicating with the introduction port 111 and the drum may have a drum introduction port communicating with the introduction port 111. The laundry treating apparatus 100 may further include a wash water supply unit to supply wash water to the tub and a wash water discharge unit to discharge wash water stored in the tub out of the cabinet 1.

On the other hand, in a case in which the laundry treating apparatus 100 is a laundry drying machine, the laundry receiving unit 2 may include only a drum rotatably provided in the cabinet 1. In this case, the laundry treating apparatus 100 may further include an air supply unit provided in the cabinet 1 to supply heated air to the drum and to discharge the air supplied to the drum out of the drum.

The laundry treating apparatus 100 may be a laundry washing and drying machine. In such a case, the laundry receiving unit 2 may include a tub, a drum, and an air supply unit provided in the cabinet 1 to supply heated air to the tub and to discharge the air in the tub out of the tub.

Figure 3:
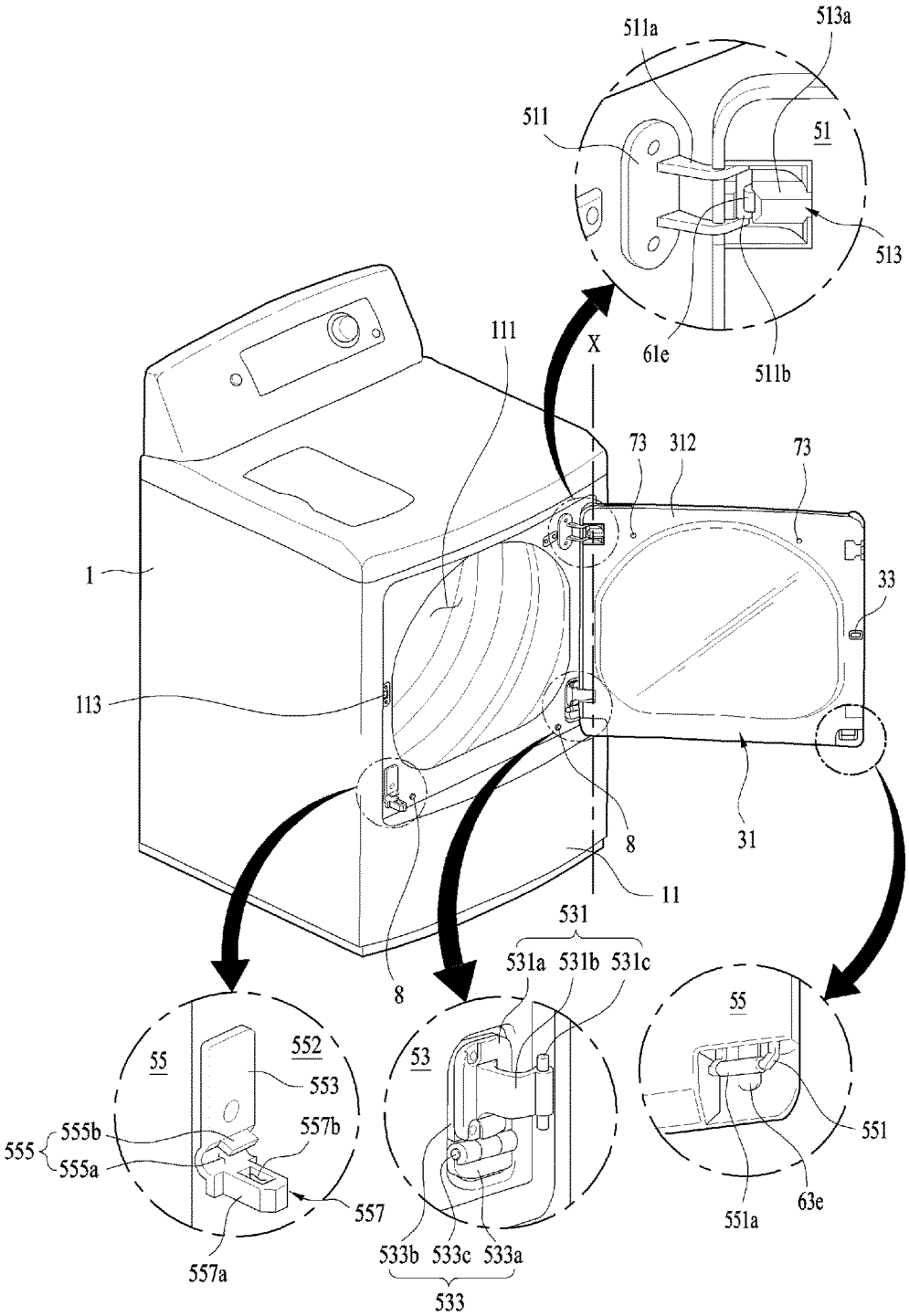

The door 3 provided at the front panel 11 to open and close the introduction port 111 may be rotated about two different rotational axes X (FIG. 3) and Y (FIG. 1). The door 3 may be coupled to the front panel 11 via a hinge unit 51, 53, and 55, as shown in FIG. 3. The user may switch between the rotational axes X (FIG. 3) and Y (FIG. 1) of the door 3 using a handle 4.

Figure 2:
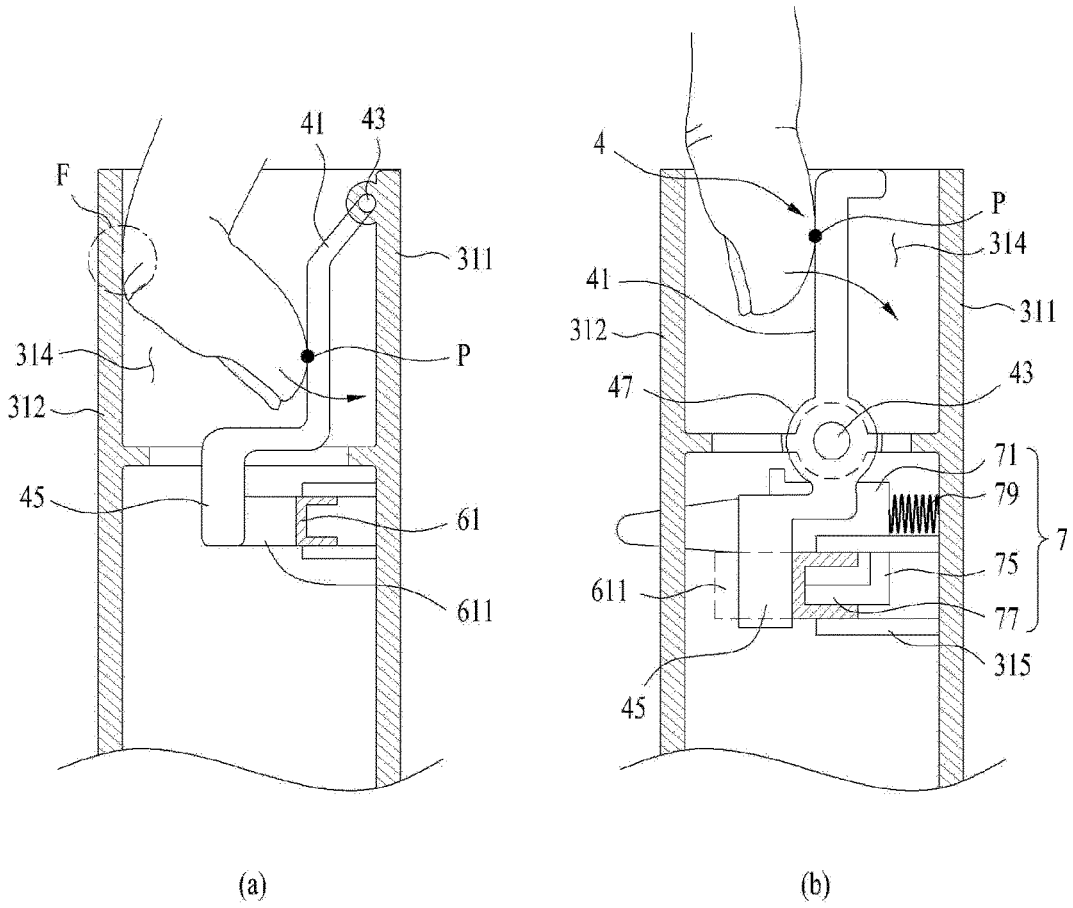
FIG. 2 is a view showing a handle provided in the laundry treating apparatus according to the embodiment of the present disclosure.

The door 3 may include a door body 31 to open and close the introduction port 111 and a door lock 33 to fix the door body 31 to the front panel 11, as shown in FIG. 3. As shown in FIGS. 1 and 2, the door body 31 may include an outer frame 311 forming the outer circumferential surface of the laundry treating apparatus 100 and an inner frame 312 coupled to the outer frame 311, the inner frame 312 being disposed on a surface of the outer frame 311 facing the front panel 11.

As shown in FIGS. 1 and 3, the door lock 33 may be provided at the inner frame 312 in a protruding fashion. In this case, the front panel 11 may further include a door lock fastening unit 113 to receive the door lock 33. Structures of the door lock 33 and the door lock fastening unit 113 to detachably fix the door body 31 to the front panel 11 are not particularly restricted. For example, the door lock 33 may include a bar protruding from the inner frame 312 and a protrusion provided at a free end of the bar and the door lock fastening unit 113 includes a groove provided at the front panel 11 to receive the protrusion by way of example.

The door body 31 is provided with a handle receiving unit 314. FIG. 1 shows a case in which the handle receiving unit 314 includes a receiving groove depressed in the upper portion of the door body 31 by way of example. In this case, the handle 4 is disposed in the receiving groove.

FIG. 2(*a*) shows a case in which the body rotation shaft 43 is positioned above a contact point P at which a finger of the user contact the handle body 41 and FIG. 2(*b*) shows a case in which the body rotation shaft 43 is positioned under the contact point P. The handle 4 may include a handle body 41 provided in the handle receiving unit 314, a body rotation shaft 43 to rotatably couple the handle body 41 to the door body 31, and a push unit 45 to operate a rotational axis switching unit 6 including first and second switch units 61 and 62, which will hereinafter be described, according to operation of the handle body 41. The rotational axis switching unit 6 is a means provided in the door body 31 to allow the user to switch between the rotational axes X and Y, which will hereinafter be described in detail.

In a case in which the body rotation shaft 43 is positioned above the contact point P (FIG. 2(*a*)), one end of the handle body 41 may be fixed to the outer frame 311 via the body rotation shaft 43 and the push unit 45 may be provided at the free end of the handle body 41. Consequently, two operations of the handle 4 shown in FIGS. 2(*a*) and 2(*b*) may be performed to open the introduction port 111.

In the first operation of FIG. 2(*a*) the user may open the introduction port 111 through a first operation of putting a finger into the handle receiving unit 314 to rotate the handle body 41 toward the outer frame 311 (an operation of operating the rotational axis switching unit 6, which will hereinafter be described) and a second operation of pulling the door body 31 away from the front panel 11 to separate the door 3 from the front panel 11. In the structure of the handle 4 shown in FIG. 2(*a*), however, the inner circumference surface of the handle receiving unit 314 may restrict (F) motion of the finger of the user when the user performs the first operation since a space provided by the handle receiving unit 314 is not wide. As a result, the user may feel inconvenient in using the door 3.

In the structure of the handle 4 shown in FIG. 2(*b*), for the second operation, only an operation of pulling the door body 31 in a direction in which the door 3 is separated from the front panel 11 may be performed to open the introduction port 111. The handle shown in FIG. 2(*b*) includes a handle body 41 provided in the handle receiving unit 314, a shaft receiving unit 47 to which the handle body 41 is fixed, a body rotation shaft 43 to rotatably couple the shaft receiving unit 47 to the door body 31, and a push unit 45 fixed to the shaft receiving unit 47, the push unit 45 being disposed in the door body 31. The handle body 41 shown in FIG. 2(*b*) may be rotated toward the outer frame 311 and the push unit 45 may be rotated toward the inner frame 312.

In the handle 4 shown in FIG. 2(*b*), a direction in which force is applied to the handle body 41 to rotate the handle body 41 is in the same direction in which the door body 31 is separated from the front panel 11. When the user puts a finger into the handle receiving unit 314 and pulls the door 3 away from the front panel 11, the rotation of the handle body 41 and separation of the door body 31 from the front panel 11 may be simultaneously performed. The door 3 may be more easily opened when the door body 31 is rotated about the second rotational axis Y than in the handle 4 shown in FIG. 2(*a*). Furthermore, interference between the finger of the user and the handle receiving unit 314 may be prevented.

As shown in FIG. 3, the hinge units (51, 53, and 55) to couple the door body 31 to the front panel 11 may include a first hinge 51, a second hinge 53 and a third hinge 55. The first hinge 51 includes a first shaft 511*b*, a third hinge 55 includes a fourth shaft 551*a*, and a second hinge 53 includes a second shaft 531*c*. The first shaft 511*b* and the second shaft 531*c* allow rotation of the door body 31 about the first rotational axis X. A third shaft 533*c* and the fourth shaft 551*a* allow rotation of the door body 31 about the second rotational axis Y (see FIG. 1).

The first hinge 51 may include a first hinge body or back plate 511 provided at the front panel 11 such that the first shaft 511*b* is fixed to the first hinge body 511 and a first shaft attaching and detaching unit 513 provided at the door body 31 such that the first shaft attaching and detaching unit 513 is detachably coupled to the first shaft 511*b*. As can be appreciated, the first hinge body 511 may be provided at the door body 31 and first shaft attaching and detaching unit 513 may be provided at the front panel 11.

As shown in FIG. 3, the first hinge body 511 is provided with a shaft support unit 511*a* to support the first shaft 511*b*. The shaft support unit 511*a* may protrude from the front panel 11 and then be bent away from the introduction port 111. Alternatively, the shaft support unit 511*a* may merely protrude from the front panel 11.

The first shaft attaching and detaching unit 513 includes a housing 513*a* provided at the door body 31 and a first shaft receiving unit 513*b* (see FIG. 12) or a space provided in the housing 513*a* to receive the first shaft 511*b*. The first shaft receiving unit 513*b* may be exposed out of the inner frame 312. The hole 513*c* (see FIG. 12) formed through the housing 513*a* in a width direction W of the door body 31 such that a first switching unit 61 of the rotational axis switching unit 6 is inserted into or extracted from the hole 513*c*.

When the first switching unit 61 is reciprocated by the handle 4 in the width direction W of the door body 31, a free end 61*e* (FIGS. 3 and 4) of the first switching unit 61 may be exposed to the first shaft receiving unit 513*b* to close the first shaft receiving unit 513*b* or inserted into the switching unit through hole 513*c* to open the first shaft receiving unit 513*b*.

Figure 6:
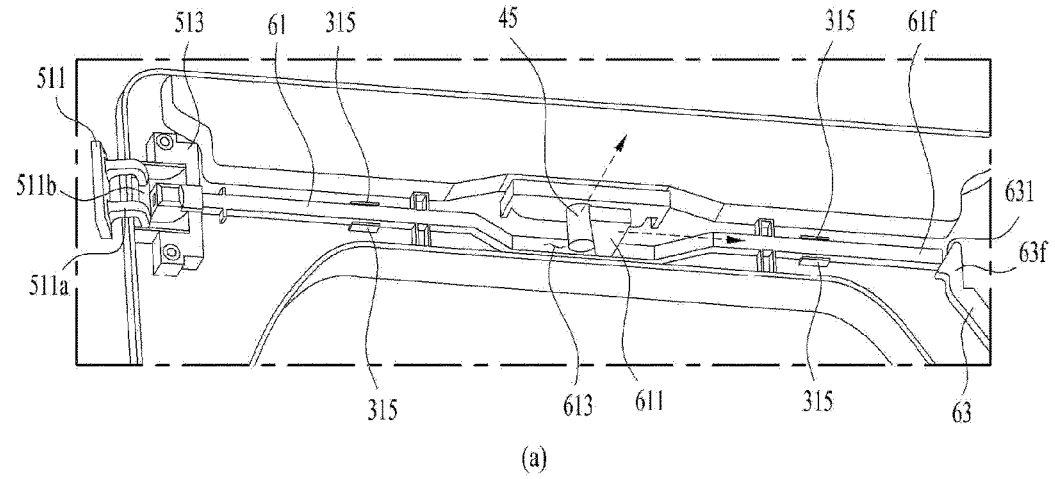
FIG. 6 is a view showing a case in which the door is connected to a second rotational axis.
Figure 6:
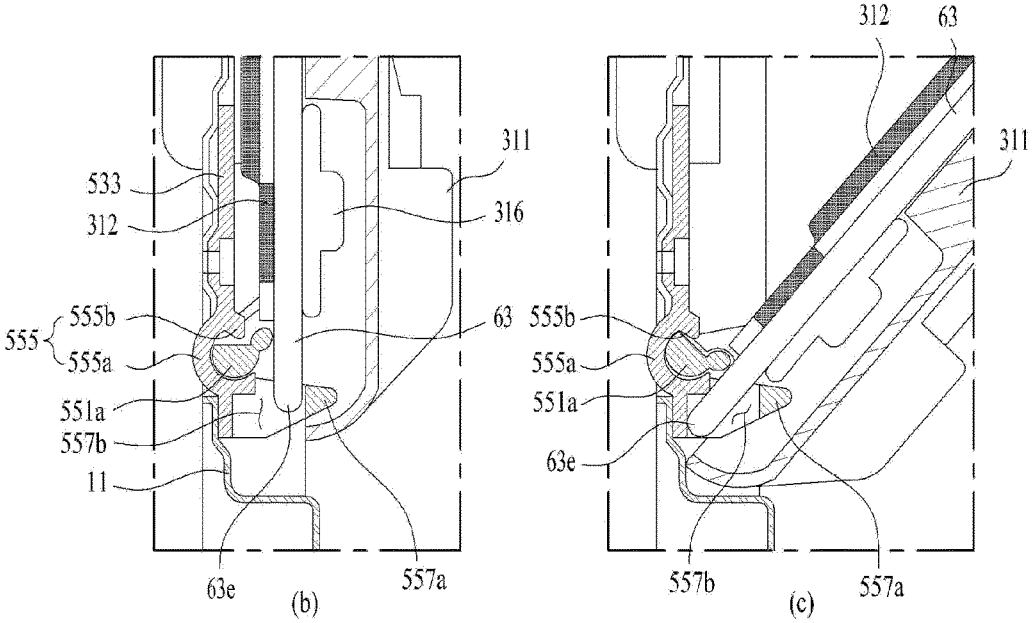

When the first shaft receiving unit 513*b* is closed by inserting the free end 61*e* into the first shaft receiving unit 513(*c*), the rotatable first shaft 511*b* is captured or held by the free end 61*e* and prevented from being withdrawn from the first shaft receiving unit 513*b*, as shown in FIG. 3, such that door 3 is rotatable in the X direction. When the first shaft receiving unit 513*b* is opened by withdrawing the free end 61*e*, the first shaft 511*b* is disengaged from the free end 61*e*, as shown in FIG. 6, such that the door 3 is rotatable in the Y direction.

The second hinge 53 may include a door support unit 531. The door support unit 531 being provided with the second shaft 531*c* and a cabinet coupling unit 533 to rotatably fix the door support unit 531 to the front panel 11. The cabinet coupling unit 533 may include a coupling unit body 533*a* fixed to the front panel 11 and a rotary plate 533*b* rotatably coupled to the coupling unit body 533*a* via the third shaft 533*c*. The door support unit 531 may include a support unit body 531*a* fixed to the rotary plate 533*b* and a shaft support unit 531*b* protruding from the support unit body 531*a* such that the second shaft 531*c* is supported by the shaft support unit 531*b*. The door body 31 is rotatably coupled to the second shaft 531*c* and the second shaft 531*c* is aligned with the first shaft 511*b* of the first hinge 51. As a result, the first rotational axis X is defined by the first shaft 511*b* and the second shaft 531*c*.

As shown in FIG. 3, the third hinge 55 may include a fourth shaft 551*a* provided at the door body 31 and a fourth shaft attaching and detaching unit 552 provided at the front panel 11. The fourth shaft 551*a* is detachably coupled to the fourth shaft attaching and detaching unit 552. As can be appreciated in an alternative configuration, the fourth shaft 551*a* may be located at the front panel 11 and unit 552 may be located at the door body 31 with appropriate modification based on the teachings of the present disclosure.

The fourth shaft 551*a* is supported by a third hinge body 551 fixed to the door body 31 and the fourth shaft 551*a* is exposed out of the inner frame 312. The fourth shaft attaching and detaching unit 552 may include an attaching and detaching unit body 553 or plate fixed to the front panel 11, a fourth shaft receiving unit 555 provided at the attaching and detaching unit body 553 to provide a space or a recess to receive the fourth shaft 551*a*, and a switching unit receiving unit 557 protruding from the attaching and detaching unit body 553. The unit 557 may be a protrusion with an opening or a recess to receive an end 63*e* of a second switching unit 63 of the rotational axis switching unit 6.

The fourth shaft receiving unit 555 may include a receiving groove 555*a* recessed in the attaching and detaching unit body 553 and a first flange 555*b* protruding from the attaching and detaching unit body 553 toward the receiving groove 555*a* to support the circumferential surface of the fourth shaft 551*a* inserted into the receiving groove 555*a*. The receiving groove 555*a* is aligned with the third shaft 553*c*. As a result, the fourth shaft 551*a* inserted into the receiving groove 555*a* allow rotation of the door body 31 about the second rotational axis Y together with the third shaft 533*c*.

The switching unit receiving unit 557 may include a second flange 557*a* protruding from the attaching and detaching unit body 553 in a state in which the second flange 557*a* is disposed under the receiving groove 555*a*. Further, a flange through hole 557*b* is formed through the second flange 557*a* such that a first free end 63*e* of the second switching unit 63 reciprocated by the first switching unit 61 in a height direction H of the door body 31 is inserted into the flange through hole 557*b*.

Figure 4:
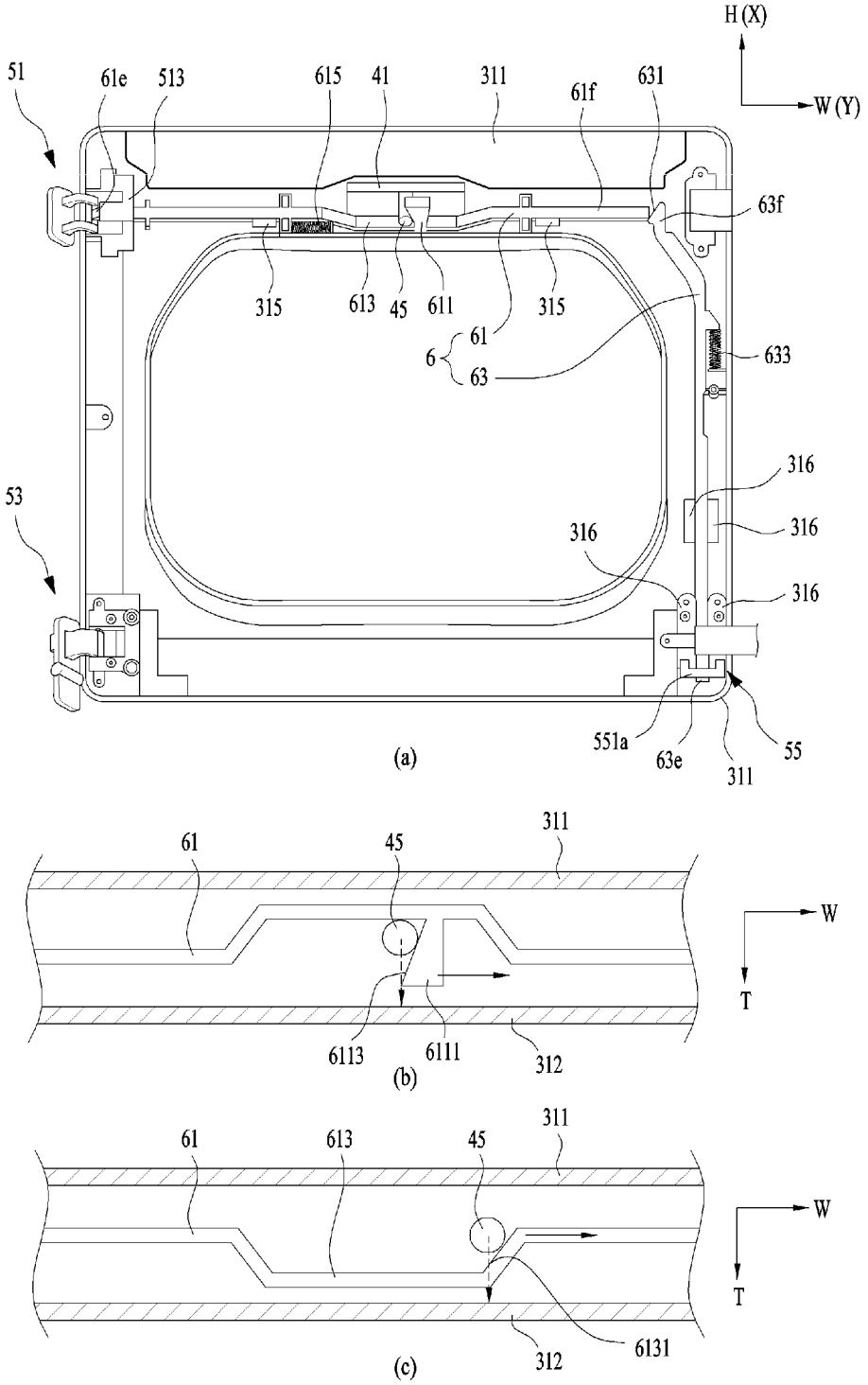
FIG. 4 is a view showing the internal structure of a door provided in the laundry treating apparatus according to the embodiment of the present disclosure.

As shown in FIG. 4, the rotational axis switching unit 6 is provided in the door body 31 to allow the user to select one of the rotational axes X and Y. The rotational axis switching unit 6 may include a first switching unit 61 reciprocated by the handle 4 in the width direction W of the door body 31 and a second switching unit 63 reciprocated by the first switching unit 61 in the height direction H of the door body 31.

The first switching unit 61 may comprise a bar or a rod disposed above the introduction port 111 while extending in the width direction W of the door body 31. A first free end 61*e* of the first switching unit 61 is inserted through hole 513*c* such that the free end 61*e* of the first switching unit 61 extends through the first shaft attaching and detaching unit 513. A second free end 61*f* of the first switching unit 61 contacts the second switching unit 63.

The first switching unit 61 is supported by a first switching unit guide 315 provided at the outer frame 311 or the inner frame 312. FIG. 4 shows a case in which the first switching unit guide 315 is provided at the outer frame 311 to guide movement of the first switching unit 61 by way of example.

As shown in FIG. 4(*b*), the first switching unit 61 is provided with a contact unit 611 or protrusion. The contact unit 611 allows movement of the first switching unit 61 in a direction in which the second switching unit 63 is positioned (in the right direction of FIG. 4) when the push unit 45 of the handle 4 is rotated toward the inner frame 312. The contact unit 611 may include a contact unit body 6111 protruding from the first switching unit 61 toward the inner frame 312 and a tilted surface 6113 provided at the contact unit body 6111 such that the tilted surface 6113 is tilted toward the first free end 61*e* while contacting the push unit 45.

When the user pushes the handle body 41, the push unit 45 moves toward the inner frame 312 and the tilted surface 6113 is moved by the push unit 45 in the direction in which the second switching unit 63 is positioned. According to the embodiment of the present disclosure, it is possible to move the first switching unit 61 in the direction in which the second switching unit 63 is positioned using the handle 4. The contact unit 611 is provided in the door body 31, which has a limited thickness. For this reason, the first switching unit 61 may further include a bent unit 613 bent toward the outer frame 311. The contact unit 611 may be provided at the bent unit 613.

In an alternative embodiment shown in FIG. 4(*c*), the bent unit 613 may be bent toward the inner frame 312. In this case, the bent unit 613 may be provided with a tilted surface (a tilted bent unit surface) 6131 contacting the push unit 45. In a case in which the bent unit 613 is provided with the tilted surface 6131 contacting the push unit 45, the contact unit 611 of FIGS. 4(*a*) and 4(*b*) may be omitted.

The second switching unit 63 may include a bar or a rod extending in the height direction H of the door body 31. A first free end (a third free end) 63*e* of the second switching unit 63 is disposed in a space between the fourth shaft 551*a* and the outer frame 311 and a second free end (a fourth free end) 63*f* of the second switching unit 63 contacts the second free end 61*f* of the first switching unit 61.

In order to easily transmit external force input to the first switching unit 61 to the second switching unit 63 through the handle 4, the second free end 61*f* of the first switching unit 61 or the second free end 63*f* of the second switching unit 63 may be further provided with a tilted switching unit surface 631. For example, FIG. 4(*a*) shows the tilted switching unit surface 631 (the tilted second switching unit surface) provided at the second switching unit 63.

The second switching unit 63 is supported by a second switching unit guide 316 provided at the outer frame 311 or the inner frame 312. FIG. 4(*a*), for example, shows the second switching unit guide 316 provided at the outer frame 311 to guide movement of the second switching unit 63.

In order to maintain a state in which the door 3 is coupled to the first rotational axis X when the door 3 closes the introduction port 111, the rotational axis switching unit 6 may further include an elastic support unit to push the first switching unit 61 toward first shaft attaching and detaching unit 513. The elastic support unit provided at the rotational axis switching unit 6 may include a second support unit 633. The second support unit 633 may include a spring having one end fixed to the second switching unit 63 and the other end fixed to the outer frame 311 or the inner frame 312. In a natural state or uncompressed state of the unit 633, the first free end 63*e* of the second switching unit 63 is positioned away from the switching unit receiving unit 557 while elastically supporting the second switching unit 63.

When the first switching unit 61 is not moved in a direction in which the first switching unit 61 pushes the second switching unit 63 through the handle 4 (the handle 4 is not manipulated), the first free end 63*e* of the second switching unit 63 remains withdrawn from the switching unit receiving unit 557 by the second support unit 633. When the first free end 63*e* of the second switching unit 63 remains withdrawn from the switching unit receiving unit 557 by the second support unit 633, the second free end 61*f* of the first switching unit 61 is pushed toward the first shaft attaching and detaching unit 513 by the second free end 63*f* of the second switching unit 63. The first shaft 511*b* is prevented from being withdrawn from the first shaft receiving unit 513*b* by the first free end 61*e* of the first switching unit 61.

According to the embodiment of the present disclosure, the door 3 remains rotatable about the first rotation axis X unless the user manipulates the handle 4 in a state in which the introduction port 111 is closed by the door 3. The reason that the door 3 remains rotatable about the first rotation axis X in a state in which the introduction port 111 is closed by the door 3 is to prevent the door 3 from opening the introduction port 111 due to weight of the door 3 when the door 3 remains coupled to the first rotation axis X.

In a case in which the door 3 remains connected to the second rotational axis Y when the introduction port 111 is closed by the door 3, the door 3 may be rotated about the second rotational axis Y without user exertion since a direction of gravity on the door 3 is in a direction in which the door 3 is rotated about the second rotational axis Y. When the door 3 remains coupled to the first rotation axis X, the above-mentioned problem may be prevented.

In addition to the second support unit 633, the elastic support unit provided at the rotational axis switching unit 6 may further include a first support unit 615 to elastically support the first switching unit 61. The first support unit 615 may include a spring to push the first free end 61*e* of the first switching unit 61 toward the first shaft receiving unit 513*b*. A switching operation between the rotational axes X and Y of the door 3 will be described with reference to FIGS. 5 and 6. See also FIG. 3.

Figure 5:
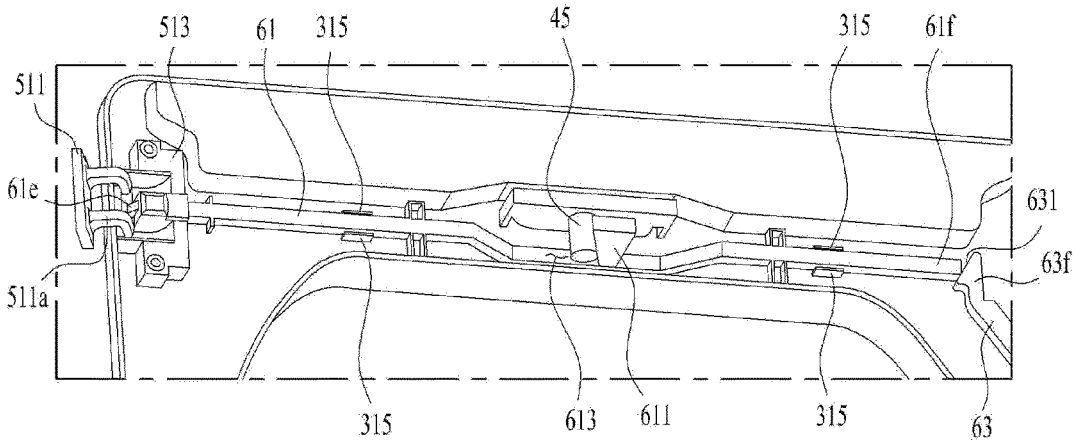
FIG. 5 is a view showing a case in which the door is connected to a first rotational axis.
Figure 5:
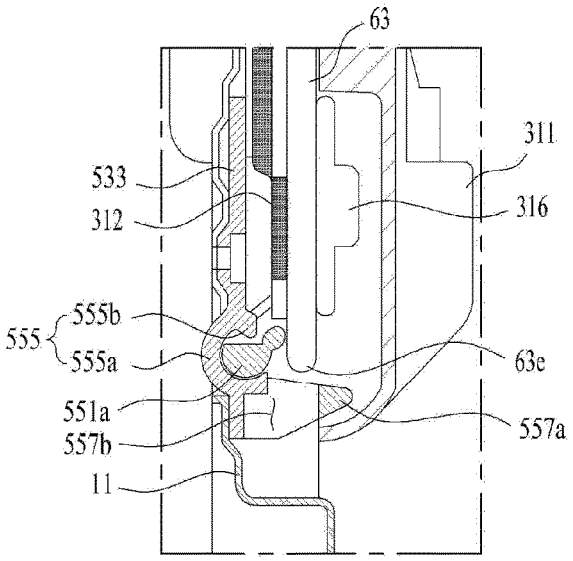

When the introduction port 111 is closed by the door 3 (in a case in which the door body 31 contacts the front panel 11 and in a case in which the handle body 41 is not pushed) as shown in FIG. 5(*a*), the first switching unit 61 is pushed toward the first hinge 51 by the first support unit 615. As a result, the first shaft 511*b* is prevented from being withdrawn from the first shaft receiving unit 513*b* by the first free end 61*e* of the first switching unit 61.

Meanwhile, the fourth shaft 551*a* remains inserted into the fourth shaft receiving unit 555 but the first free end 63*e* of the second switching unit 63 is not inserted into the flange through hole 557*b* as shown in FIG. 5(*b*). The second switching unit 63 does not move toward the fourth shaft attaching and detaching unit 552 unless the first switching unit 61 is moved by the handle 4 in a direction in which the first switching unit 61 is away from the first hinge 51 (in the right direction of FIG. 5(*a*)).

The door 3 remains rotatable about the first rotational axis X defined by the first shaft 511*b* and the second shaft 531*c*. When the user pulls the door body 31 away from the front panel 11 using the handle receiving unit 314 (the handle 4 is not pushed), the door 3 is rotated about the first rotational axis X to open the introduction port 111 (see FIG. 3).

Referring to FIG. 6, when the user pushes the handle 4 with the door 3 in a closed position, the first switching unit 61 and the second switching unit 63 performs movement. When the user pushes the handle 4, the push unit 45 moves toward the inner frame 312 to push the tilted surface 6113 provided at the contact unit 611. As a result, the first switching unit 61 moves toward the second switching unit 63. The first free end 61*e* of the first switching unit 61 moves toward the interior of the door body 31 to disengage from the first shaft 511*b*. Simultaneously, the second free end 61*f* of the first switching unit 61 pushes the tilted surface 631 of the second switching unit 63.

When the first free end 61*e* of the first switching unit 61 moves toward the interior of the door body 31, the first shaft 511*b* may be withdrawn from the first shaft receiving unit 513*b*. The second free end 61*f* of the first switching unit 61 pushes the tilted surface 631 of the second switching unit 63, and the first free end 63*e* of the second switching unit 63 is inserted into the flange through hole 557*b*. See also FIG. 3. As a result, the fourth shaft 551*a* is prevented from being withdrawn from the fourth shaft receiving unit 555 (FIG. 6(*b*)).

When the user pushes the handle body 41 in a state in which the introduction port 111 is closed by the door 3, therefore, the door 3 may be rotated about the second rotational axis Y defined by the fourth shaft 551*a* and the third shaft 533*c* (see FIG. 1). When the user pulls the door body 31 away from the front panel 11 while pushing the handle body 41, the door 3 is rotated about the second rotational axis Y to open the introduction port 111 (FIG. 6(*c*)).

In the laundry treating apparatus 100 as described above, the first rotational axis X may be a vertical axis perpendicular to the bottom of the cabinet 1 and the second rotational axis Y may be a horizontal axis parallel to the bottom of the cabinet 1. However, the present disclosure is not limited thereto.

In the laundry treating apparatus 100 having the above-described structure, there my be a risk that the first shaft 511*b* may be separated from the first shaft attaching and detaching unit 513 in a case in which the user accidentally pushes the handle body 41 when the door body 31 is rotated about the first rotational axis X. Furthermore, in the laundry treating apparatus 100 having the above-described structure, the handle body 41 must be kept pushed when the door body 31 is rotated about the second rotational axis Y in order to prevent the fourth shaft 551*a* from being separated from the fourth shaft receiving unit 555.

Figure 7:
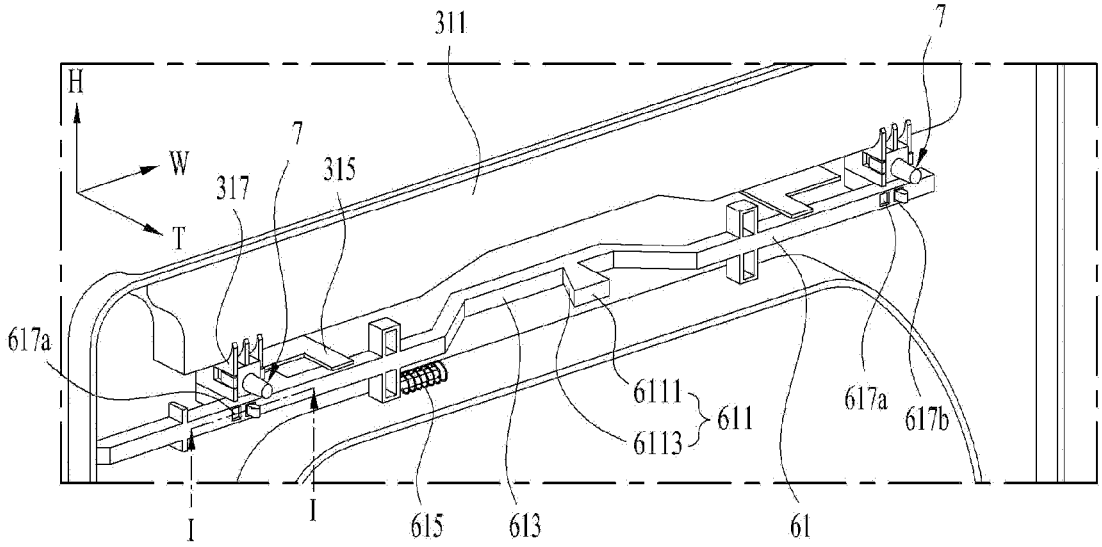
FIGS. 7 and 8 are views showing a lock provided in a first switching unit.
Figure 7:
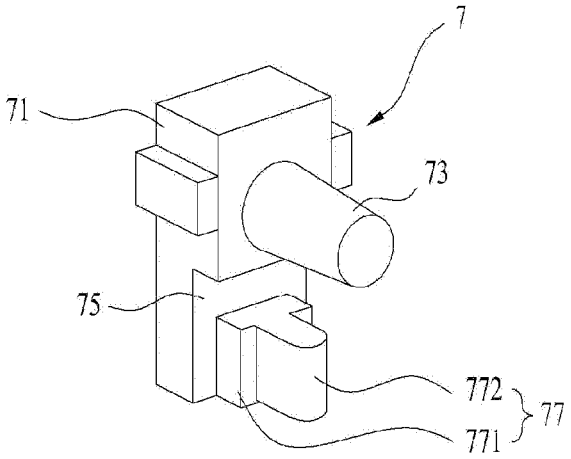

In order to solve the above problems and as shown in FIG. 7, the laundry treating apparatus 100 according to the embodiment of the present disclosure may further include a lock 7 to fix the position of the first switching unit 61 and/or the second switching unit 63 (to restrain the first switching unit 61 or the second switching unit 63) when the introduction port 111 is opened by the door 3 (when the door body 31 is rotated from the front panel 11).

The lock 7 may include a lock body 71, a body push unit 73, and a fixing unit 77 provided in the door body 31 such that the lock body 71 can move in a thickness direction T of the door body 31. The body push unit 73 extends through the inner frame 312 such that the body push unit 73 is exposed out of the door body 31. The fixing unit 77 is attachable to or detachable from the first switching unit 61 according to operation of the lock body 71.

When the lock 7 is provided in the door body 31, the outer frame 311 may further include a lock body receiving groove 317 to receive the lock body 71. The inner frame 312 may further include a frame through hole 313 (see FIG. 8) through which the body push unit 73 extends. The first switching unit 61 may further include a fastening unit 617 to which the fixing unit 77 is coupled.

The lock body receiving groove 317 provides a guide movement of the lock body 71. The lock body receiving groove 317 may be formed in the shape of a hollow bar having an open side facing the inner frame 312. The lock body receiving groove 317 may be provided at any position of the outer frame 311 unless reciprocation of the lock body 71 does not interfere with the first switching unit 61.

Figure 8:
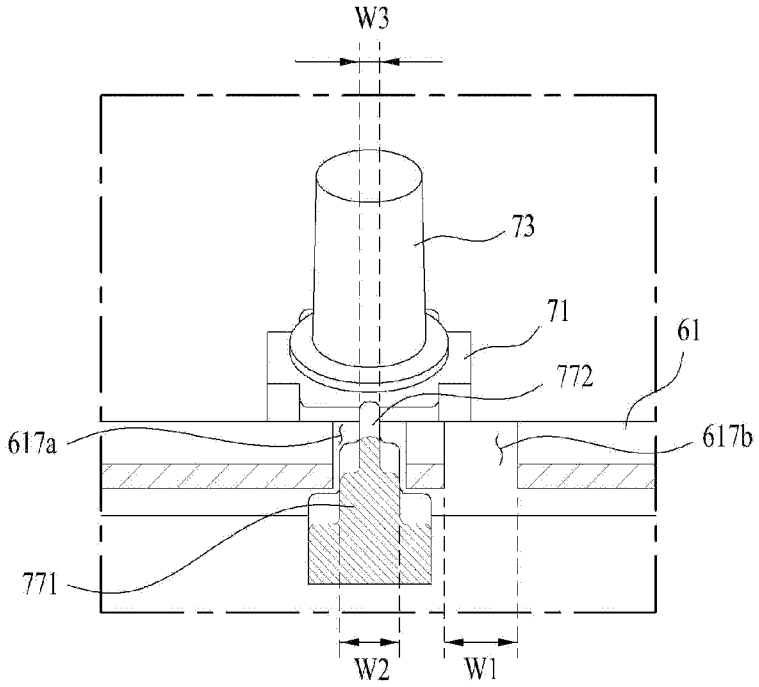
Figure 8:
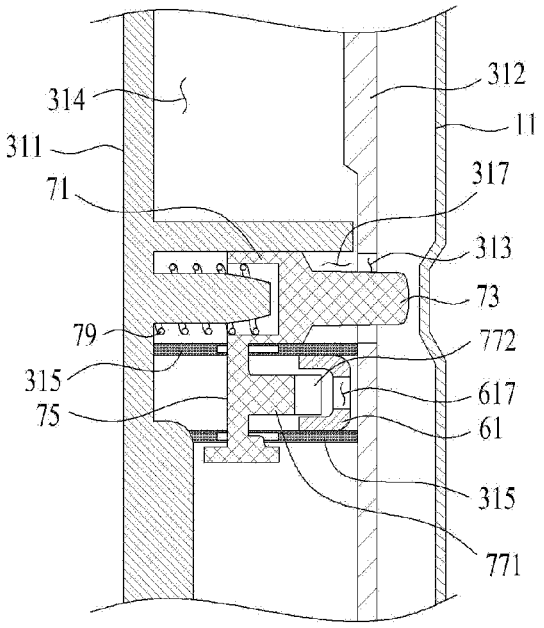

As an example, FIG. 8 shows the lock body receiving groove 317 being positioned above the first switching unit 61. A body support unit 79 or spring elastically supports the lock body 71 in the lock body receiving groove 317. The body support unit 79 applies elastic force to push the lock body 71 toward the inner frame 312 to the lock body 71.

When the lock body 71 is provided above the first switching unit 61 in the height direction H of the door body 31, the fixing unit 77 may be provided at a body flange 75 extending from the lock body 71 toward a space defined between the first switching unit 61 and the outer frame 311. The body flange 75 may extend from the lock body 71 toward the lower part of the door body 31 such that the body flange 75 is positioned between the first switching unit 61 and the outer frame 311. The fixing unit 77 may protrude from the body flange 75 toward the fastening unit 617 provided at the first switching unit 61.

The fastening unit 617 may include a first fastening unit 617*a* and a second fastening unit 617*b* provided in the width direction W of the door body 31. The distance from the first free end 61*e* of the first switching unit 61 to the second fastening unit 617*b* may be greater than the distance from the first free end 61*e* of the first switching unit 61 to the first fastening unit 617*a*. The respective fastening units 617*a* and 617*b* may be provided as fastening holes formed through the first switching unit 61 or fastening grooves depressed in the first switching unit 61. FIGS. 7 and 8 show a case in which the respective fastening units 617*a* and 617*b* are provided as fastening holes by way of example.

The fixing unit 7 may include a first fixing protrusion 771 protruding from the body flange 75. The first fixing protrusion 771 may be inserted into any one selected from between the first fastening unit 617*a* and the second fastening unit 617*b* according to the position of the first switching unit 61. When the first fastening unit 617*a* and the second fastening unit 617*b* have the same width w1, the first fixing protrusion 771 has a width w2 equal to or less than the width w1 of the first fastening unit 617*a* and the second fastening unit 617*b*. The movement distance of the first switching unit 61 in the width direction W of door body 31 may be changed according to a degree in which the user pushes the handle body 41 (a rotational degree of the push unit 45).

When the fixing unit 77 includes only the first fixing protrusion 771, the first fixing protrusion 771 may not be coupled to one of the two fastening units 617*a* and 617*b* if the user does not sufficiently rotate the push unit 45 using the handle body 41. In order to solve the above problem, the lock 7 provided in the laundry treating apparatus 100 may further include a second fixing protrusion 772 provided at the first fixing protrusion 771. The second fixing protrusion 772 has a width w3 less than the width w2 of the first fixing protrusion 771.

When the second fixing protrusion 772 is provided at the middle of the top surface of the first fixing protrusion 771 or a corner of the top surface of the first fixing protrusion 771 facing the first free end 61*e* of the first switching unit 61 (facing the first hinge 51), the movement distance of the first switching unit 61 needed for the first fastening unit 617*a* to move to the front of the second fixing protrusion 772 positioned at the rear of the second fastening unit 617*b* is less than the movement distance of the first switching unit 61 needed for the first fastening unit 617*a* to move to the front of the first fixing protrusion 771 positioned at the rear of the second fastening unit 617*b*.

When the second fixing protrusion 772 having the width w3 less than the width w2 of the first fixing protrusion 771 is provided at the first fixing protrusion 771, the first fastening unit 617*a* may be positioned at the front of the fixing unit 77 even when the push unit 45 is slightly moved. As a result, the unit 77 may be easily coupled to the fastening unit 617.

An operation of the door 3 having the lock 7 opening the introduction port 111 and an operation of switching between the rotational axes X and Y are carried out as follows.

As shown in FIG. 8(*b*), the body push unit 73 is pushed by the front panel 11 in a closed position of the door body 31 which is rotatable about the Y axis. As a result, the lock body 71 moves in the lock body receiving groove 317 toward the outer frame 311. At this time, the body support unit 79 is compressed by the lock body 71.

When the lock body 71 moves in the lock body receiving groove 317 toward the outer frame 311, the fixing unit 77 is withdrawn from the first fastening unit 617*a* and the first switching unit 61 is moved toward the first hinge 51 by the first support unit 615. When the first switching unit 61 is moved toward the first hinge 51 by the first support unit 615, the second fastening unit 617*b* is positioned at the front of the fixing unit 77, the first free end 61*e* of the first switching unit 61 is prevented from being separated from the first shaft receiving unit 513*b*, and the first free end 63*e* of the second switching unit 63 is withdrawn from the flange through hole 557*b*.

When the user pulls the door body 31 in the handle receiving unit 314 without pushing the handle body 41 in this state, the door body 31 rotates about the first rotational axis X. When the door body 31 starts to rotate about the first rotational axis X, contact between the body push unit 73 and the front panel 11 is released. As a result, external force to push the body push unit 73 toward the outer frame 311 is removed.

Consequently, the lock body 71 is moved toward the inner frame 312 by restoring force of the body support unit 79. When the lock body 71 is moved toward the inner frame 312, the fixing unit 77 is inserted into the second fastening unit 617*b*. When the fixing unit 77 is inserted into the second fastening unit 617*b*, the position of the first switching unit 61 is fixed. As a result, the first shaft 511*b* is prevented from being withdrawn from the first shaft receiving unit 513*b* even when the user pushes the handle body 41 during rotation of the door body 31 about the first rotational axis X.

When the introduction port 111 is closed by the door body 31 rotated about the first rotational axis X, on the other hand, the body push unit 73 is pushed by the front panel 11. As a result, the lock body 71 moves in the lock body receiving groove 317 toward the outer frame 311. Consequently, the fixing unit 77 is withdrawn from the second fastening unit 617*b* (restraint of the first switching unit 61 is released).

When the user pushes the handle body 41 in this state, the second free end 61*f* of the first switching unit 61 pushes the tilted surface 631 provided at the second free end 63*f* of the second switching unit 63. As a result, the first free end 61*e* of the first switching unit 61 opens the first shaft receiving unit 513*b* such that the first shaft 511*b* can be separated from the first shaft attaching and detaching unit 513, the first free end 63*e* of the second switching unit 63 is inserted into the flange through hole 557*b*, and the first fastening unit 617*a* is positioned at the front of the fixing unit 77.

At this time, when the user separates the door body 31 from the front panel 11 while pushing the handle body 41, the door body 31 starts to rotate about the second rotational axis Y.

When the door body 31 starts to rotate about the second rotational axis Y, contact between the body push unit 73 and the front panel 11 is released. When external force to push the body push unit 73 toward the outer frame 311 is removed, the fixing unit 77 is inserted into the first fastening unit 617*a* to maintain a state in which the second switching unit 63 is pushed by the first switching unit 61.

According to the embodiment of the present disclosure, therefore, the fourth shaft 551*a* may be prevented from being separated from the fourth shaft receiving unit 555 during rotation of the door body 31 although the handle body 41 does not remain pushed when the door body 31 rotates about the second rotational axis Y.

In the above description, the lock 7 is configured such that the fixing unit 77 reciprocates between the rear of the first switching unit 61 and the outer frame 311. Alternatively, the lock 7 may be configured such that the fixing unit 77 reciprocates between the inner frame 312 and the front of the first switching unit 61 to fix the first switching unit 61.

In addition, the lock 7 may be configured such that the body pushing unit 73 is separated from the block body 71 and fixed to the front panel 11. In this case, when the door body 31 comes into contact with the front panel 11, the body pushing unit 73 may be inserted into the frame through hole 313 of the inner frame 312 to push the block body 71. In the above description, the lock 7 is configured such that the fixing unit 77 fixes the position of the first switching unit 61.

Alternatively, the lock 7 may be configured such that the fixing unit 77 fixes the position of the second switching unit 63. In this case, the first fastening unit 617*a* and the second fastening unit 617*b* may be provided at the second switching unit 63 and the distance from the first free end 63*e* of the second switching unit 63 to the first fastening unit 617*a* may be less than the distance from the first free end 63*e* of the second switching unit 63 to the second fastening unit 617*b*. When the fixing unit 77 is coupled to the first fastening unit 617*a*, therefore, the door 3 is coupled to the first rotational axis X. When the fixing unit 77 is coupled to the second fastening unit 617*b*, on the other hand, the door 3 is coupled to the second rotational axis Y.

Figure 9:
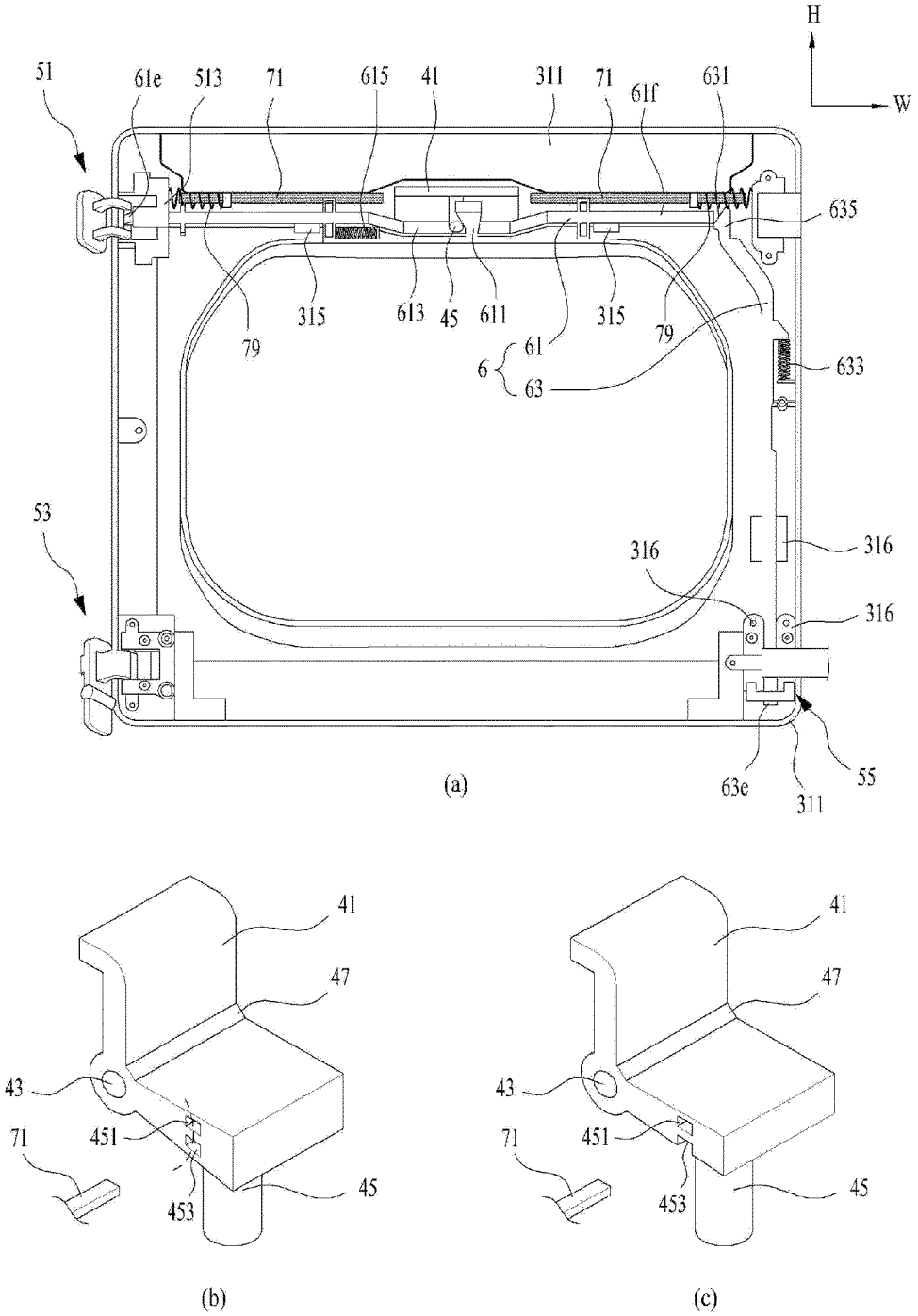
FIGS. 9 and 10 are views showing another embodiment of the lock.

FIG. 9 is a view showing a case in which the lock 7 is provided to fix the handle 4. In a case in which the lock 7 is provided to fix the handle 4, the handle body 41 may include a first body fastening unit 451 to which the lock 7 is detachably coupled and a second body fastening unit 453 disposed under the first body fastening unit 451. The first body fastening unit 451 and the second body fastening unit 453 may be positioned on an arc having the body rotation shaft 43 as the center and may comprise openings or recesses.

Figure 10:
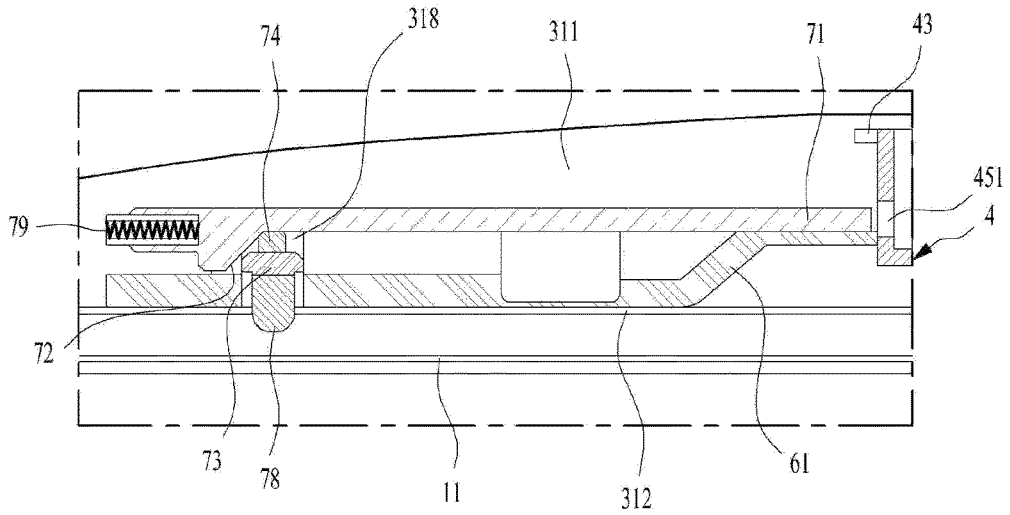
Figure 10:
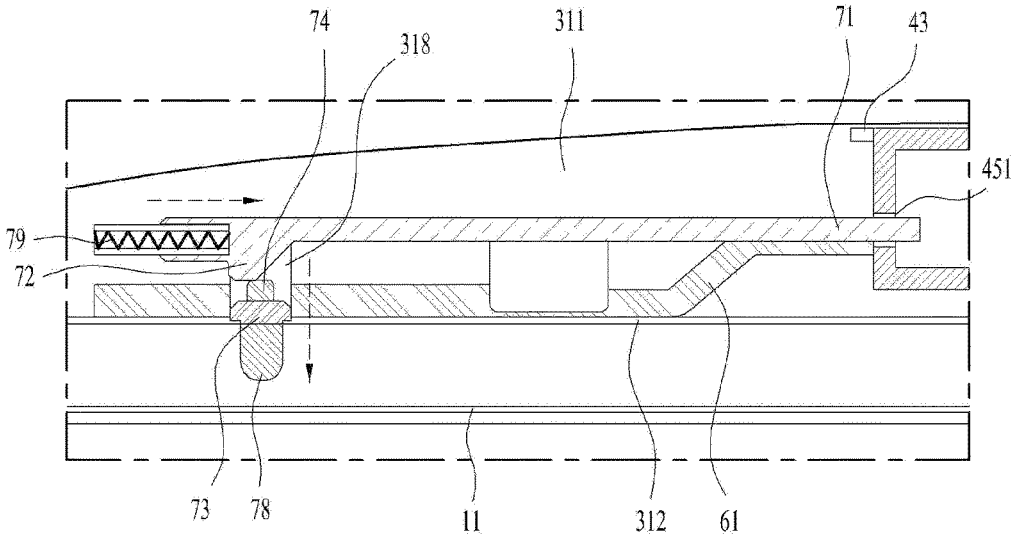

As shown in FIG. 10, the lock 7 according to this embodiment may include a lock body 71, a body support unit 79, a tilted body surface 72 and a body push unit 73. The block body 71 reciprocates in the width direction W of the door body 31 such that the lock body can be inserted into the first body fastening unit 451 or the second body fastening unit 453. A body support unit 79 pushes the lock body 71 in a direction in which the handle 4 is positioned while elastically supporting the lock body 71. A tilted body surface 72 is provided at the lock body 71, and a body push unit 73 moves the lock body 71 while contacting the tilted body surface 72 when the introduction port 111 is closed by the door 3.

The body push unit 73 may be provided to reciprocate in the door body 31 in the thickness direction T of the door 3. Alternatively, the body push unit 73 may be provided at the front panel to push the tilted body surface 72 when the introduction port 111 is closed by the door 3.

FIG. 10 shows a case in which the body push unit 73 is capable of reciprocating in the thickness direction T of the door 3 by way of example. The door body 31 may be further provided with a push unit guide 318 to guide reciprocation of the body push unit 73. The push unit guide 318 must be provided not to interfere with the rotational axis switching unit 6. FIG. 10 shows a case in which the push unit guide 318 is positioned above the first switching unit 61. The body push unit 73 may include a first body push unit 74 protruding from the body push unit 73 toward the tilted body surface 72 and a second body push unit 78 protruding from the body push unit 73 toward the front panel 11.

When the introduction port 111 is closed by the door body 31, the second body push unit 78 is pushed by the front panel 11. As a result, the first body push unit 74 may contact the tilted body surface 72 to move the lock body 71 away from the handle 4.

When the introduction port 111 is opened by the door body 31, external force applied to the second body push unit 78 is removed. As a result, the lock body 71 is moved toward the handle 4 by the body support unit 79 and the first body push unit 74 is moved toward the inner frame 312 by the tilted body surface 72. The second body push unit 78 returns to a state in which the second body push unit 78 is exposed out of the inner frame 312 (an initial position) (see FIG. 10(*b*)).

In order to assist the body push unit 73 to return to the initial position, the door body 31 may further include a push unit support unit to elastically support the body push unit 73.

Even in this embodiment, in a state in which the introduction port 111 is closed by the door body 31, the first switching unit 61 prevents the first shaft 511*b* from being withdrawn from the first shaft receiving unit 513*b* and the lock body 71 does not restrain the handle 4 (the lock body 71 is not inserted into the first body fastening unit 451) (FIG. 10(*a*)).

When the door 3 rotates about the first rotational axis X to open the introduction port 111, however, external force applied to the second body push unit 78 is removed. As a result, the free end of the lock body 71 is inserted into the first body fastening unit 451 by the body support unit 79.

Even in this embodiment, therefore, it is possible to prevent the first shaft 511*b* from being withdrawn from the first shaft receiving unit 513*b* due to operation of the handle 4 when the door 3 rotates about the first rotational axis X.

When the door 3 rotates about the second rotational axis Y, on the other hand, the free end of the lock body 71 is coupled to the second body fastening unit 453 to restrain the handle 4. In order for the door 3 to rotate about the second rotational axis Y, the user must move the first switching unit 61 using the handle body 41 to push the second switching unit 63.

As previously described, the second body fastening unit 453 is provided under the first body fastening unit 451 on the circumference of a circle having the body rotation shaft 43 as the center and passing through the first body fastening unit 451. When the user rotates the handle body 41, therefore, the first body fastening unit 451 deviates from a reciprocation path of the lock body 71 and the second body fastening unit 453 is positioned on the reciprocation path of the lock body 71.

When the user separates the door body 31 from the front panel 11 in this state, the free end of the lock body 71 moves toward the handle 4 and is then inserted into the second body fastening unit 453. In this embodiment, therefore, it is possible to prevent the fourth shaft 551*a* from being withdrawn from the fourth shaft receiving unit 555 due to operation of the handle 4 when the door body 31 rotates about the second rotational axis Y.

FIG. 9(*b*) shows an example in which the first body fastening unit 451 and the second body fastening unit 453 are provided in the form of fastening holes formed through the handle body 41 or grooves depressed in the handle body 41. However, the first body fastening unit 451 and the second body fastening unit 453 may be modified to have various structures so long as the first body fastening unit 451 and the second body fastening unit 453 can perform the above function. FIG. 9(*c*) shows an example in which at least one selected from between the first body fastening unit 451 and the second body fastening unit 453 is provided at the edge of the handle body 41 in the form of a groove.

In addition, the lock 7 provided in the laundry treating apparatus 100 according to the embodiment of the present disclosure may include a body push unit 73, a first body push unit 74 protruding from the body push unit 73 toward the tilted body surface 72, and a second body push unit 78 provided at the front panel 11 to push the first body push unit 74 toward the tilted body surface 72 when the introduction port 111 is closed by the door body 31.

In this case, the inner frame 312 of the door body 31 may further include an insertion hole, into which the second body push unit 78 is inserted when the introduction port 111 is closed by the door body 31, and the body push unit 73 may contact the insertion hole when the second body push unit 78 is inserted into the insertion hole.

In the laundry treating apparatus 100 having the above-described structure, the door lock 33 is coupled to the door lock fastening unit 113 when the introduction port 111 is closed by the door body 31 having rotated about the second rotational axis Y to open the introduction port 111. At this time, however, the first shaft 511*b* may not be coupled to the first shaft receiving unit 513*b*.

Figure 11:
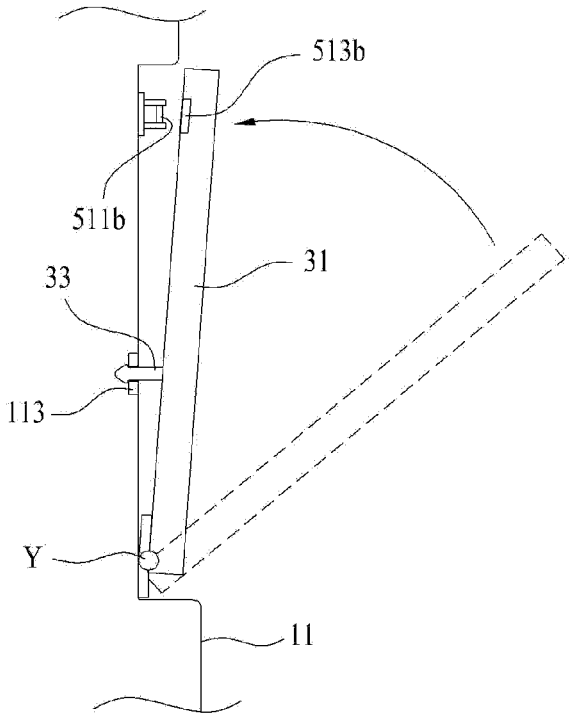
FIGS. 11 and 12 are views showing a laundry treating apparatus according to another embodiment of the present disclosure.
Figure 11:
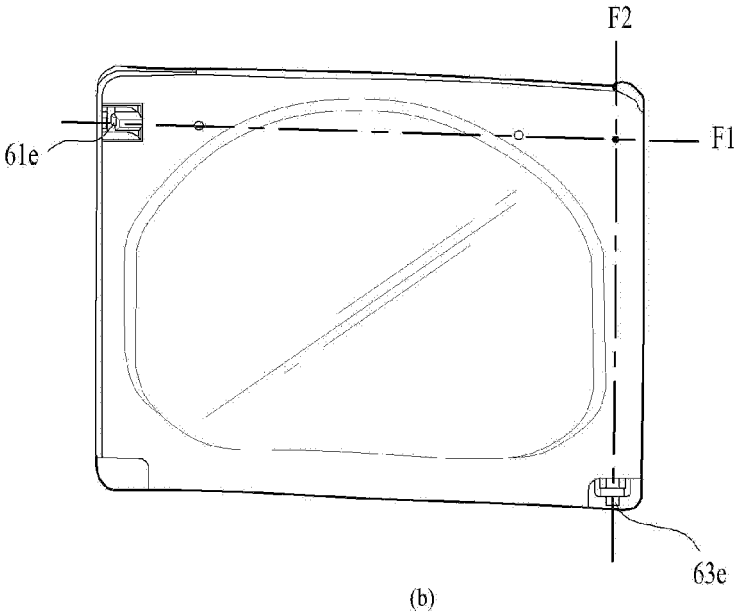

Since the distance from the second rotational axis Y to the door lock 33 is less than the distance from the second rotational axis Y to the first shaft receiving unit 513*b* as shown in FIG. 11(*a*), a process in which the door lock 33 is coupled to the door lock fastening unit 113 is performed earlier than a process in which the first shaft 511*b* is coupled to the first shaft receiving unit 513*b* when the introduction port 111 is closed by the door body 31.

As a result, the user may misunderstand that the introduction port 111 is completely closed by the door body 31 when the door lock 33 is coupled to the door lock fastening unit 113 although the first shaft 511*b* is not coupled to the first shaft receiving unit 513*b*.

In a case in which the first shaft 511*b* is not coupled to the first shaft receiving unit 513*b* in a state in which the introduction port 111 is closed by the door body 31, the user cannot rotate the door body 31 about the first rotational axis X.

In addition, in a case in which the introduction port 111 is closed by the door body 31 in a state in which the first shaft 511*b* is not coupled to the first shaft receiving unit 513*b*, the fourth shaft 551*a* may be withdrawn from the fourth shaft attaching and detaching unit 552 according to circumstances (in a case in which the lock 7 is separated from the rotational axis switching unit 6). As a result, it may be difficult for the door body 31 to rotate about the second rotational axis Y.

In order to solve the above problem, in the laundry treating apparatus 100 according to the embodiment of the present disclosure, the door lock 33 may be provided on a horizontal line F1 parallel to the second rotational axis Y while passing through the first shaft receiving unit 513*b*. In a case in which the first shaft receiving unit 513 and the door lock 33 are positioned on the horizontal line F1 parallel to the second rotational axis Y as shown in FIG. 11(*b*), the above-mentioned problem may be solved.

Meanwhile, the door lock 33 provided in the laundry treating apparatus 100 according to the embodiment of the present disclosure may be positioned on a straight line configured such that the distance between a horizontal line parallel to the second rotational axis Y while passing through the door lock 33 and the second rotational axis Y is greater than the distance between the horizontal line F1 parallel to the second rotational axis Y while passing through the first shaft receiving unit 513*b* and the second rotational axis Y.

In a case in which the distance from the second rotational axis Y to the door lock 33 is greater than the distance from the second rotational axis Y to the first shaft receiving unit 513*b*, coupling between the first shaft 511*b* and the first shaft receiving unit 513*b* is performed earlier than coupling between the door lock 33 and the door lock fastening unit 113, thereby solving the above-mentioned problem.

In a case in which the door lock 33 is positioned adjacent to the first shaft receiving unit 513*b*, however, it may be difficult to achieve coupling between the door lock 33 and the door lock fastening unit 113 when the door 3 rotates about the first rotational axis X to close the introduction port 111. In order to solve the above problem, the door lock 33 provided in the laundry treating apparatus 100 according to the embodiment of the present disclosure may be positioned on an intersection point between the horizontal line F1 parallel to the second rotational axis Y while passing through the first shaft receiving unit 513*b* and a vertical line F2 parallel to the first rotational axis X while passing through the fourth shaft 551*a*.

Figure 12:
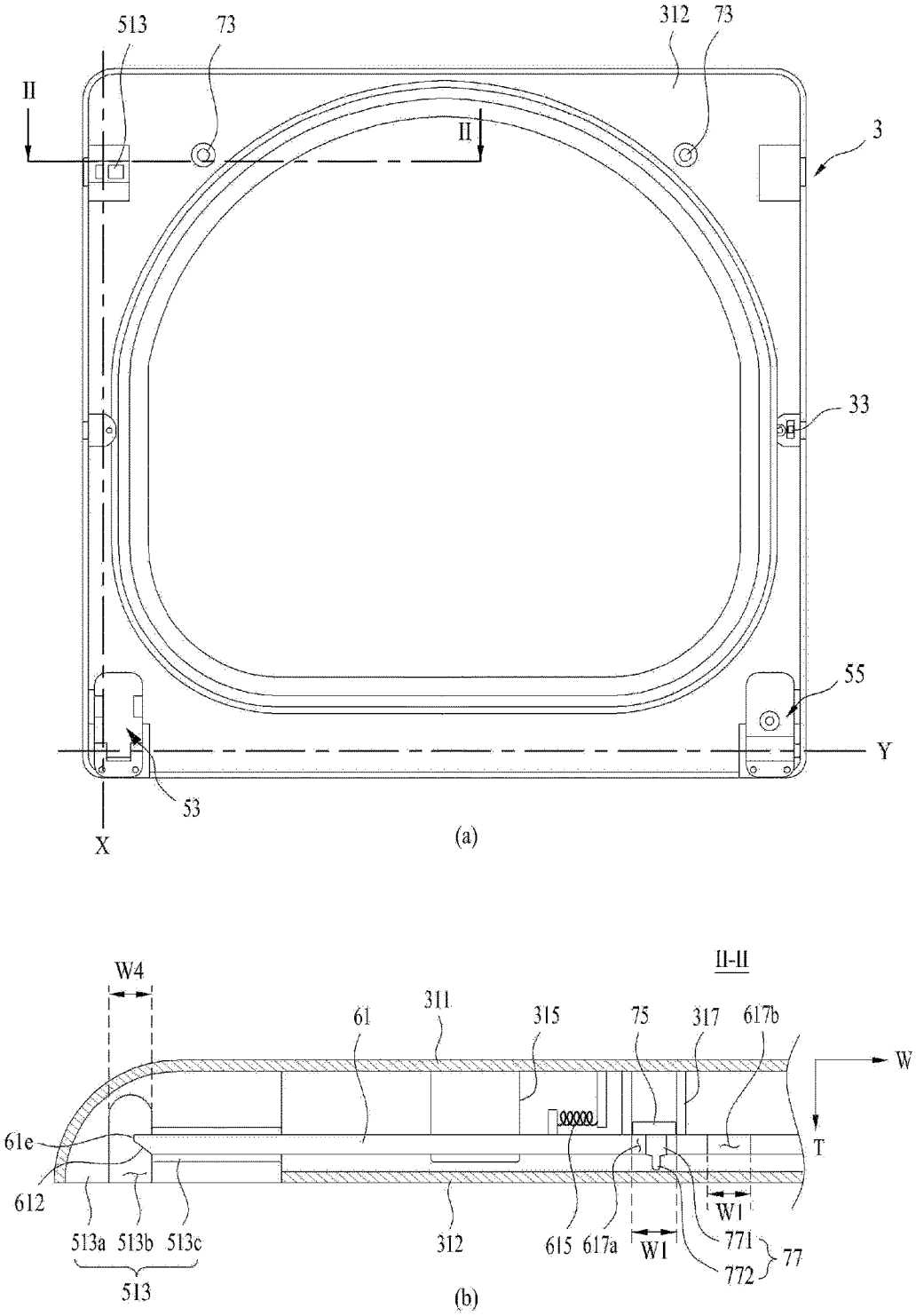

In this case, the vertical line F2 may be positioned away from the first rotational axis X on the basis of a vertical line passing through the center of the door 3. In order to solve the problem that the first shaft 511*b* is not coupled to the first shaft receiving unit 513*b* due to the door lock 33, on the other hand, the laundry treating apparatus 100 according to the embodiment of the present disclosure may be configured as shown in FIG. 12.

The laundry treating apparatus 100 according to the embodiment of the present disclosure may be configured such that the first free end 61*e* of the first switching unit 61 protrudes into the first shaft receiving unit 513*b* in a state in which the door body 31 can rotate about the second rotational axis Y.

In a case in which the first free end 61*e* of the first switching unit 61 remains protruding into the first shaft receiving unit 513*b*, the user may determine whether the first shaft 511*b* is coupled to the first shaft receiving unit 513*b* based on repulsive force applied from the first free end 61*e* of the first switching unit 61 to the first shaft 511*b* when the door body 31 is rotated about the second rotational axis Y to close the introduction port 111, sound generated when the first shaft 511*b* passes the first free end 61*e* of the first switching unit 61, etc.

To this end, the first free end 61*e* of the first switching unit 61 may protrude into the first shaft receiving unit 513*b* while not completely closing the first shaft receiving unit 513*b*. This is because it is necessary for the first shaft receiving unit 513*b* to have a space in which the first free end 61*e* of the first switching unit 61 can move such that the first free end 63*e* of the second switching unit 63 can be withdrawn from the switching unit receiving unit 557 of the third hinge 55 when the fixing unit 77 is separated from the first fastening unit 617*a* as the result of contact between the door body 31 and the front panel 11.

FIG. 12(*b*) shows an example in which the first free end 61*e* of the first switching unit 61 protrudes by a length equal to or less than half a width w4 of the first shaft receiving unit 513*b*. The length (w1−w2) obtained by subtracting the width w2 of the first fixing protrusion 771 from the width w1 of the first fastening unit 617*a* may be equal to or greater than the length of the first free end 61*e* of the first switching unit 61 protruding into the first shaft receiving unit 513*b* such that sound can be generated when the first shaft 511*b* passes the first free end 61*e* of the first switching unit 61.

When the user rotates the door body 31 about the second rotational axis Y toward the front panel 11, the first shaft 511*b* pushes the first free end 61*e* of the first switching unit 61 during insertion of the first shaft 511*b* into the first shaft receiving unit 513*b* (at this time, the user may feel repulsive force generated from the first free end 61*e* of the first switching unit 61).

Since the width w1 of the first fastening unit 617*a* is greater than the width w2 of the first fixing protrusion 771 and the first switching unit 61 is supported by the first support unit 615, the first free end 61*e* of the first switching unit 61 may move into the switching unit through hole 513*c* even in a state in which the first fixing protrusion 771 is inserted into the first fastening unit 617*a*. The first free end 61*e* of the first switching unit 61 may be further provided with a tilted switching unit surface 612 (a tilted first switching unit surface) tilted in a direction in which the first shaft 511*b* is inserted into the first shaft receiving unit 513*b* such that the first shaft 511*b* can easily push the first free end 61*e* of the first switching unit 61.

The first free end 61*e* of the first switching unit 61 inserted into the switching unit through hole 513*c* is withdrawn from the switching unit through hole 513*c* by the first support unit 615 after the first shaft 511*b* passes the first free end 61*e* of the first switching unit 61. In this process, the first fixing protrusion 772 or the second fixing protrusion 772 may collide with the first fastening unit 617*a* with the result that sound is generated. Consequently, the user may recognize whether the first shaft 511*b* has been coupled to the first shaft attaching and detaching unit 513.

Meanwhile, the door body 31 contacts the front panel 11 almost simultaneously with the above-described process. As a result, the fixing unit 77 is withdrawn from the first fastening unit 617*a*. When the fixing unit 77 is withdrawn from the first fastening unit 617*a*, the first free end 61*e* of the first switching unit 61 closes the first shaft receiving unit 513*b* due to the first support unit 615. Consequently, the first shaft 511*b* is prevented from being withdrawn from the first shaft receiving unit 513*b* and the first free end 63*e* of the second switching unit 63 is withdrawn from the flange through hole 557*b* of the third hinge 55.

Figure 13:
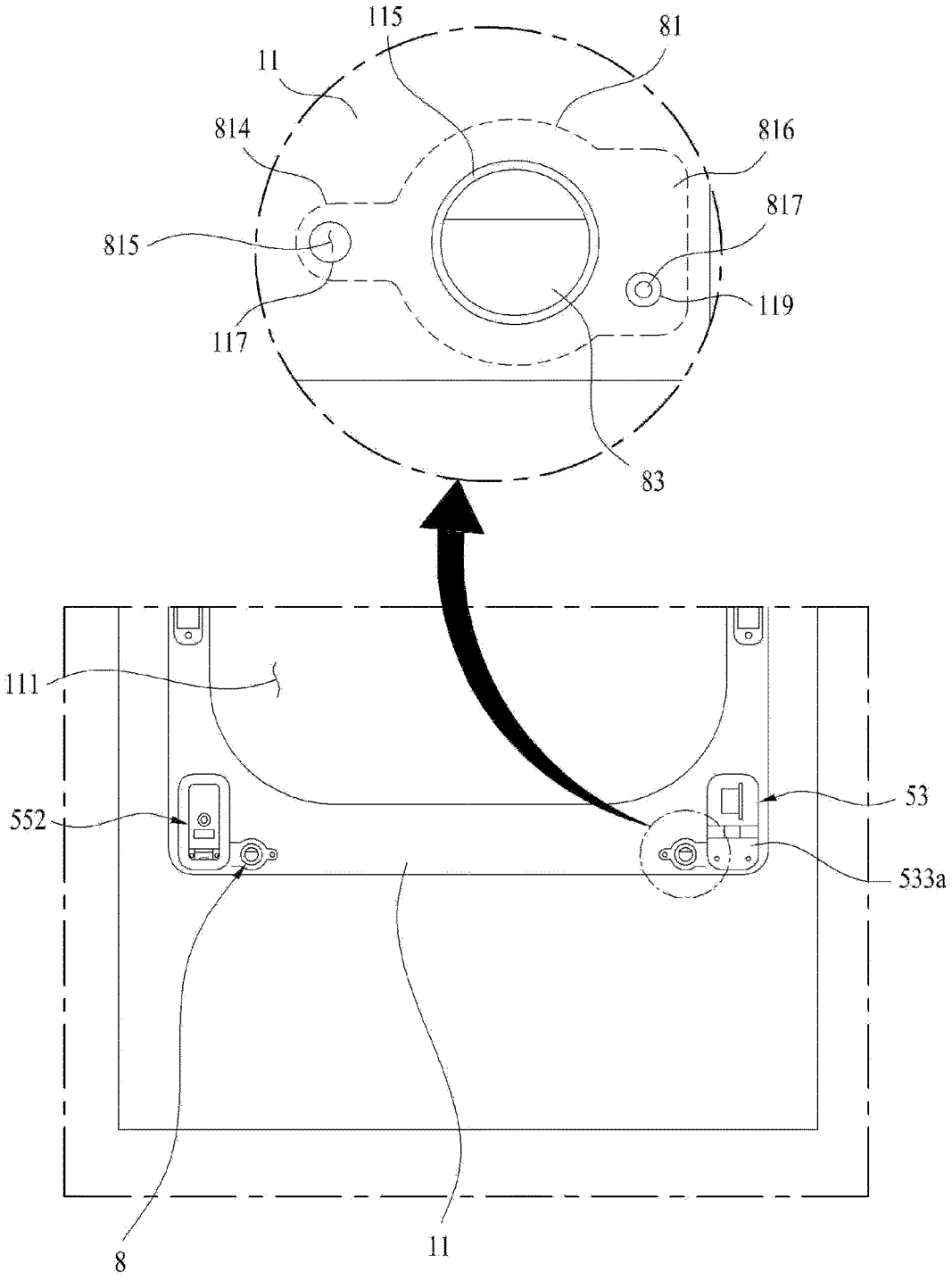
FIGS. 13 and 14 are views showing a damper provided in the laundry treating apparatus according to the embodiment of the present disclosure.
Figure 14:
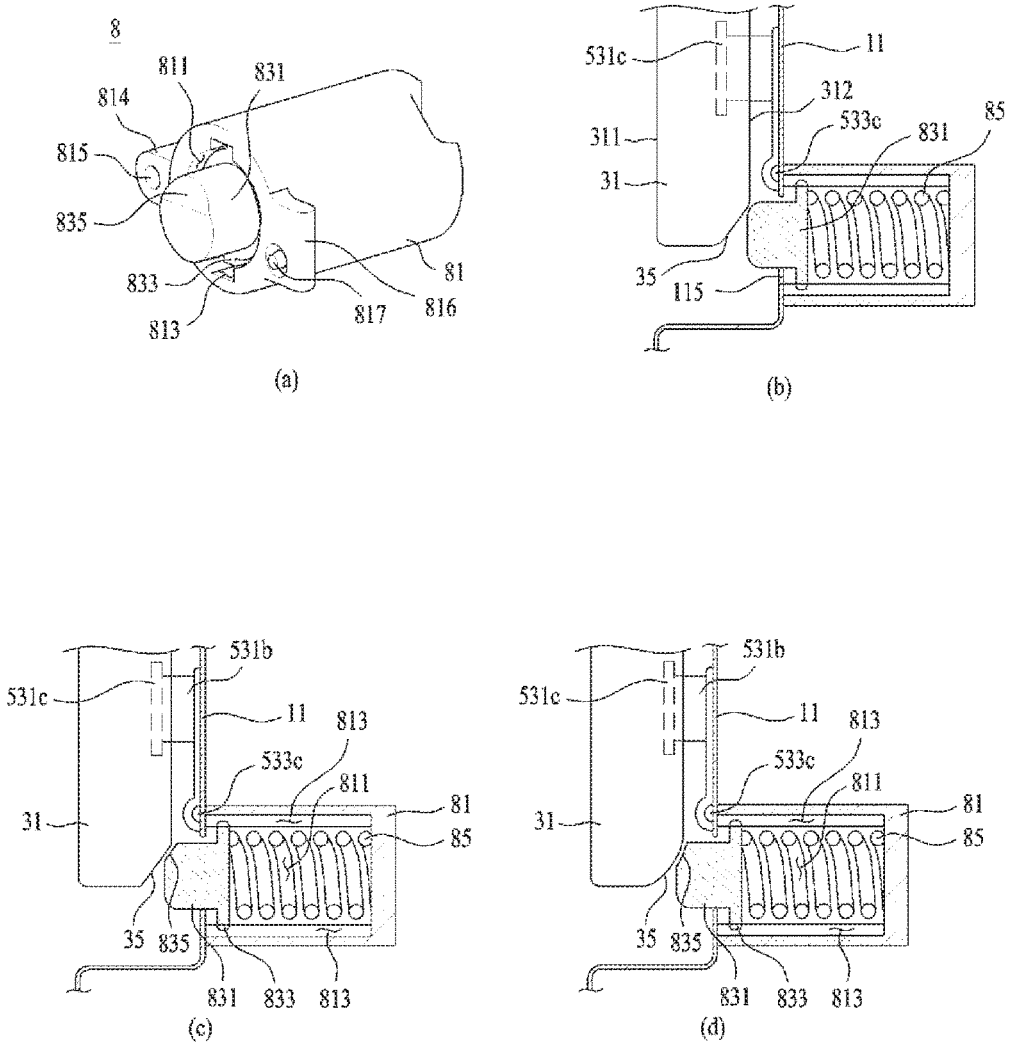

In the laundry treating apparatus 100 having the above-described structure, the hinge 5 may be damaged due to weight of the door body 31 when the door body 31 rotates too fast about the second rotational axis Y. In order to solve the above problem, the laundry treating apparatus 100 according to the embodiment of the present disclosure may further include a damper 8 to adjust rotational speed of the door body 31. As shown in FIGS. 13 and 14, the damper 8 may be provided at the front panel 11 to support the door 3.

The damper 8 provided in the laundry treating apparatus 100 according to the embodiment of the present disclosure may include a damper housing 81 fixed to the rear surface of the front panel 11, a piston 83 provided in the damper housing 81 in a reciprocating fashion, and a piston support unit 85 provided in the damper housing 81 to support the piston 83. The piston 83 has a free end contact the door 3.

The damper housing 81 may be formed in the shape of a hollow cylinder open at one side thereof. A piston receiving groove 811 open at one side thereof is provided in the damper housing 81 and the piston 83 is inserted into the piston receiving groove 811 such that the piston 83 can reciprocate along a horizontal line perpendicular to the front panel 11.

The damper housing 81 may include a first housing flange 814 protruding from the outer circumferential surface thereof and a housing fixing hole 815 provided at the first housing flange 814 to couple the damper housing 81 to the front panel 11. The housing fixing hole 815 is provided so as to correspond to a damper fixing hole 117 provided at the front panel 11. When a fastening member, such as a screw, is inserted into the housing fixing hole 815 through the damper fixing hole 117, the damper housing 81 is fixed to the front panel 11.

The piston 83 may include a piston body 831 inserted into the piston receiving groove 811 of the damper housing 81 such that the piston body 831 is supported by the piston support unit 85.

A free end of the piston body 831 is exposed out of the front panel 11 through a piston through hole 115 provided at the front panel 11. In this case, the free end of the piston body 831 may contact the inner frame 312 of the door 3 as shown in FIG. 14(*b*).

In a case in which the free end of the piston body 831 does not contact the door 3 but is spaced apart from the door 3 by a certain distance in a state in which the introduction port 11 is closed by the door 3, the door body 31 may rotate without being supported by the damper 8 in a certain section when the door 3 rotated about the second rotational axis Y with the result that rotational speed of the door body 31 may excessively increase.

In a case in which a contact surface 35 tilted away from the front panel 11 is provided at the lower end of one side (the inner frame 312) of the door body 31 facing the front panel 11, on the other hand, the inner frame 312 may slide without pushing the piston body 831 during rotation of the door body 31 in the structure shown in FIG. 14(*b*).

The contact surface 35 minimizes a turning radius of the edge of the door body 31 to minimize the distance between the door body 31 and the front panel 11. In addition, a rotational angle of the door body 31 is restricted when the door body 31 rotates about the second rotational axis Y (a maximum rotational angel setting means).

In order to prevent the door body 31 from sliding without pushing the piston body 831, the piston body 831 may further include a tilted piston surface 835 contacting the contact surface 35 (FIG. 14(*c*)). In this case, the contact area between the piston body 831 and the door body 31 is increased such that the contact surface 35 can minimize sliding of the door body 31 without pushing the piston body 831 during rotation of the door body 31. The tilted piston surface 835 may have a section corresponding to that of the contact surface 35.

In a case in which the contact surface 33 is a flat surface tilted away from the front panel 11 (a tilted door surface), the tilted piston surface 835 may be a flat surface having the same tilt angle as the contact surface 35 (FIG. 14(*c*)). On the other hand, in a case in which the contact surface 35 is a curved surface having a radius of curvature, the tilted piston surface 835 may be a curved surface having the same radius of curvature as the contact surface 33 (FIG. 14(*d*)).

In a case in which the tilted piston surface 835 is provided at the piston body 831, the tilted piston surface 835 must be positioned above a horizontal line passing through the middle of the piston body 831 such that the tilted piston surface 835 can support the contact surface 35 of the door body 31. For this reason, if the top and bottom direction of the damper 8 is changed due to an error of a worker when the damper 8 is assembled to the front panel 11, the damper 8 shown in FIG. 14(*c*) may not function properly. In order to prevent incorrect assembly between the damper 8 and the front panel 11, a first position setting unit 817 may be further provided at the damper housing 81 and a second position setting unit 119 may be further provided at the front panel 11. As can be appreciated, the location of the units 817 and 119 can be switched.

FIGS. 13 and 14 show an example in which the first position setting unit 817 is provided at the damper housing 81 and the second position setting unit 119 is provided at the front panel 11. The first position setting unit 817 may be provided at a second flange 816 protruding from the outer circumferential surface of the damper housing 81 and the second position setting unit 119 may be provided as a receiving groove or a receiving hole to receive the first position setting unit 817. However, the first position setting unit 817 must not be positioned on a horizontal line passing through the housing fixing hole 815. This requirement is based on the directivity of the damper housing 81 being removed if the first position setting unit 817 is positioned on the straight line passing through the housing fixing hole 815.

If the piston body 831 can rotate in the piston receiving groove 811 of the damper housing 81 despite the presence of the position setting units 817 and 119, the tilted piston surface 835 may not function properly. In order to prevent rotation of the piston body 831 in the piston receiving groove 811, a guide 833 may be provided at the outer circumferential surface of the piston body 831 and a guide groove 813 to receive the guide 833 may be further provided at the piston receiving groove 811. The guide 833 may protrude from the outer circumferential surface of the piston body 831 and the guide groove 813 may be depressed in the piston receiving groove 811 while extending in a longitudinal direction of the damper housing 81.

The damper housing 81 is fixed to the front panel 11 through one housing fixing hole 815. For this reason, it may be difficult to expect a desired effect through the damper 8 in a case in which the damper housing 81 is pushed away from the front panel 11 due to weight of the door 3. In order to solve the above problem, the laundry treating apparatus 100 according to the embodiment of the present disclosure may further include a bracket 87 to fix the damper housing 81 to the front panel 11.

Figure 15:
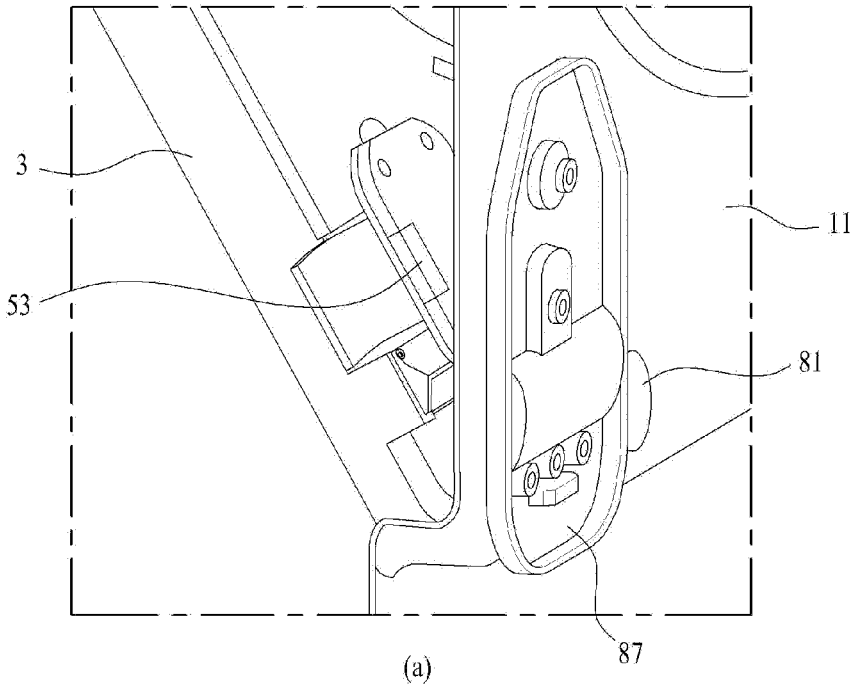
FIG. 15 is a view showing a fixing bracket to fix the damper to a cabinet.
Figure 15:
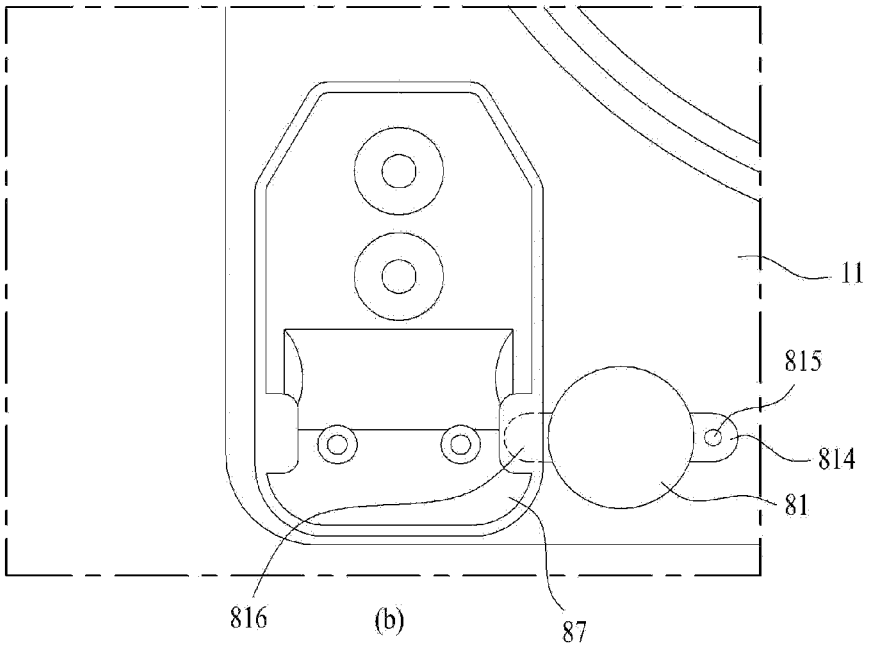

As shown in FIG. 15, the bracket 87 is fixed to the front panel 11 to prevent the second flange 816 from being separated from the front panel 11. In a case in which two dampers 8 are provided at the front panel 11, two brackets 87 may also be provided accordingly. In addition, the bracket 87 may function to support the cabinet coupling unit 533 of the second hinge 53 or the fourth shaft attaching and detaching unit 552 of the third hinge 55.

The coupling unit body 533*a* of the cabinet coupling unit 533 positioned at the front surface of the front panel 11 may be fixed to the bracket 87 positioned at the rear surface of the front panel 11 through the front panel 11. The fourth shaft attaching and detaching unit 552 may also be fixed to the bracket 87 positioned at the rear surface of the front panel 11. In this case, it is possible to effectively prevent movement of damper 8 to the rear of the front panel 11.

When the door 3 rotates about the second rotational axis Y, force directed to the rear of the front panel 11 is applied to the damper 8. In a case in which the bracket 87 is provided to support the cabinet coupling unit 533 or the fourth shaft attaching and detaching unit 552, external force directed to the front of the front panel 11 is applied to the bracket 87 during rotation of the door 3, thereby preventing the damper housing 81 from being separated from the front panel 11.

In the above description, the damper 8 is provided in the laundry treating apparatus 100 that enables the user to switch between the rotational axes X and Y of the door 3. However, the present disclosure is not limited thereto. For example, the damper 8 may be provided in a laundry treating apparatus configured such that the door body 31 can rotate only about the second rotational axis Y.

As is apparent from the above description, the present disclosure has the effect of providing a laundry treating apparatus having a plurality of rotational axes about which a door can rotate in different directions.

In addition, the present disclosure has the effect of providing a laundry treating apparatus that enables a user to switch between rotational axes.

In addition, the present disclosure has the effect of providing a laundry treating apparatus that prevents switching between rotational axes during rotation of a door.

In addition, the present disclosure has the effect of providing a laundry treating apparatus that is capable of solving a problem that an introduction port, through which laundry to be washed is introduced or removed, is not completely closed by a door.

In addition, the present disclosure has the effect of providing a laundry treating apparatus that is capable of rotational speed of a door to prevent damage to means to support the door and other different components of the laundry treating apparatus.

Accordingly, the present invention is directed to a laundry treating apparatus that substantially obviates one or more problems due to limitations and disadvantages of the related art.

An object of the present invention is to provide a laundry treating apparatus having a plurality of rotational axes about which a door can rotate in different directions.

Another object of the present invention is to provide a laundry treating apparatus that enables a user to switch between rotational axes.

Another object of the present invention is to provide a laundry treating apparatus that prevents switching between rotational axes during rotation of a door.

Another object of the present invention is to provide a laundry treating apparatus that is capable of solving a problem that an introduction port, through which laundry to be washed is introduced or removed, is not completely closed by a door.

A further object of the present invention is to provide a laundry treating apparatus that is capable of rotational speed of a door to prevent damage to means to support the door and other different components of the laundry treating apparatus.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry treating apparatus includes a cabinet including a front panel having an introduction port, a laundry receiving unit provided in the cabinet to provide a space to receive laundry supplied through the introduction port, a door including a door body rotatably provided at a front panel through a horizontal axis parallel to a bottom surface of the front panel to open and close the introduction port and a contact surface provided at one surface of the door body facing the front panel while being tilted away from the front panel, and a damper including a damper housing fixed to the front panel, a piston having one end provided in the damper housing and a free end contacting the door in a state in which the introduction port is closed, a piston support unit provided in the damper housing to elastically support the piston, and an inclined piston surface provided at the free end of the piston to support the contact surface.

The contact surface may be provided as a flat surface and the inclined piston surface may have the same tilt angle as the contact surface.

The contact surface may be provided as a curved surface and the inclined piston surface may have the same curvature as the contact surface.

The damper may further include a guide protruding from an outer circumferential surface of the piston and a guide groove provided at the damper housing to provide a space to receive guide, the guide groove defining a movement path of the guide.

The damper housing may be fixed to a rear surface of the front panel and the free end of the piston may extend through the front panel to support the contact surface.

The damper may further include a housing fixing hole provided at an outer circumferential surface of the damper housing and a first position setting unit provided at the outer circumferential surface of the damper housing such that the first position setting unit is not positioned on a horizontal line passing through a center of the housing fixing hole, and the front panel may further include a damper fixing hole corresponding to the housing fixing hole and a second position setting unit to which the first position setting unit is coupled.

The damper may further include a housing flange protruding from the outer circumferential surface of the damper housing, the first position setting unit being provided at the housing flange, and the first position setting unit may be provided as a protrusion protruding from the housing flange and the second position setting unit may be provided as a groove or a hole provided at the front panel to receive the protrusion.

The damper may further include a housing flange protruding from the outer circumferential surface of the damper housing and a bracket fixed to a rear surface of the front panel such that the housing flange is pushed toward the front panel.

The laundry treating apparatus may further include a first hinge including a first shaft provided at one selected from between the front panel and the door to define a vertical axis perpendicular to the bottom surface of the front panel and a first shaft receiving unit provided at the other selected from between the front panel and the door to receive the first shaft, a second hinge including a second shaft coupled to the door to define the vertical axis together with the first shaft, a coupling unit body fixed to the front panel, and a third shaft to rotatably fix the second shaft to the coupling unit body while defining the horizontal axis, a third hinge including a fourth shaft provided at one selected from between the front panel and the door to define the horizontal axis together with the third shaft and a fourth shaft receiving unit provided at the other selected from between the front panel and the door to receive the fourth shaft, a first switching unit provided in the door in a reciprocating fashion to open and close the first shaft receiving unit, and a second switching unit provided in the door in a reciprocating fashion to open and close the fourth shaft receiving unit, the second switching unit closing the fourth shaft receiving unit when the first switching unit moves in a direction in which the first shaft receiving unit is opened.

The damper housing may be fixed to the rear surface of the front panel and the free end of the piston may extend through the front panel to support the contact surface.

The damper may further include a housing fixing hole provided at an outer circumferential surface of the damper housing, a housing flange protruding from the outer circumferential surface of the damper housing, and a first position setting unit provided at the housing flange such that the first position setting unit is not positioned on a horizontal line passing through a center of the housing fixing hole, and the front panel may further include a damper fixing hole corresponding to the housing fixing hole and a second position setting unit to which the first position setting unit is coupled.

The laundry treating apparatus may further include a bracket provided at the rear surface of the front panel such that any one selected from between the coupling unit body and the fourth shaft receiving unit is fixed to the bracket, wherein the bracket may be fixed to the rear surface of the front panel such that the housing flange is pushed toward the front panel.

It is to be understood that both the foregoing general description and the following detailed description of the present invention are exemplary and explanatory and are intended to provide further explanation of the invention as claimed.

This application relates to U.S. application Ser. Nos. 14/619,459 and 14/619,638, both filed on Feb. 11, 2015, which are hereby incorporated by reference in their entirety. Further, one of ordinary skill in the art will recognize that features disclosed in these above-noted applications may be combined in any combination with features disclosed herein.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treating apparatus comprising:

a cabinet having a front panel with an introduction port;

a chamber provided in the cabinet to provide a space to receive laundry supplied through the introduction port;

a door provided at a front panel, the door having a door body configured to open and close the introduction port by rotating about a horizontal axis parallel to a bottom surface of the front panel, wherein the door body includes a contact surface provided at one side thereof to face the front panel at an oblique angle when the door is closed; and a damper including a damper housing fixed to the front panel, a piston having a first end arranged in the damper housing and a second end contacting the door when the door is closed, a piston support unit arranged in the damper housing to elastically support the piston, wherein the second end of the piston has an inclined piston surface to support the contact surface, wherein the contact surface has a flat surface, and the inclined piston surface is arranged parallel therewith when the door is closed.

2. The laundry treating apparatus according to claim 1, wherein the damper further comprises:

a guide protruding from an outer circumferential surface of the piston; and a guide groove provided at the damper housing for receiving and defining a movement path of the guide.

3. The laundry treating apparatus according to claim 1, wherein the damper housing is fixed to a rear surface of the front panel, and the second end of the piston extends through the front panel to support the contact surface.

4. The laundry treating apparatus according to claim 1, wherein the damper further comprises a housing fixing hole provided at an outer circumferential surface of the damper housing and a first position setting unit provided at the outer circumferential surface of the damper housing such that the first position setting unit is not positioned on a horizontal line passing through a center of the housing fixing hole, and the front panel further comprises a damper fixing hole corresponding to the housing fixing hole and a second position setting unit to which the first position setting unit is coupled.

5. The laundry treating apparatus according to claim 4, wherein the damper further comprises a housing flange protruding from the outer circumferential surface of the damper housing, the first position setting unit being provided at the housing flange, and the first position setting unit has a protrusion protruding from the housing flange and the second position setting unit has a groove or a hole provided at the front panel to receive the protrusion.

6. The laundry treating apparatus according to claim 4, wherein the damper further comprises:

a housing flange protruding from the outer circumferential surface of the damper housing; and a bracket fixed to the rear surface of the front panel such that the housing flange is pushed toward the front panel.

7. The laundry treating apparatus according to claim 6, further comprising:

a first hinge having a first shaft provided at the front panel to define a vertical axis and a first shaft receiving unit provided at the door to receive the first shaft;

a second hinge having a second shaft coupled to the door to define the vertical axis together with the first shaft, a coupling unit body fixed to the front panel, and a third shaft adapted to rotatably fix the second shaft to the coupling unit body while defining the horizontal axis;

a third hinge comprising a fourth shaft provided at the front panel and the door to define the horizontal axis together with the third shaft and a fourth shaft receiving unit provided at the door to receive the fourth shaft;

a first switching unit provided at the door, and configured to move so as to open and close the first shaft receiving unit; and a second switching unit provided at the door, and configured to move so as to open and close the fourth shaft receiving unit, the second switching unit being adapted for closing the fourth shaft receiving unit when the first switching unit opens the first shaft receiving unit.

8. The laundry treating apparatus according to claim 7, wherein the bracket is configured to fix at least one of the coupling unit body or the fourth shaft receiving unit thereto.

9. A laundry treating apparatus comprising:

a cabinet having a front panel with an introduction port;

a chamber provided in the cabinet to provide a space to receive laundry supplied through the introduction port;

a door provided at a front panel, the door having a door body configured to open and close the introduction port by rotating about a horizontal axis parallel to a bottom surface of the front panel, wherein the door body includes a contact surface provided at one side thereof to face the front panel at an oblique angle when the door is closed; and a damper including a damper housing fixed to the front panel, a piston having a first end arranged in the damper housing and a second end contacting the door when the door is closed, a piston support unit arranged in the damper housing to elastically support the piston, wherein the second end of the piston has an inclined piston surface to support the contact surface, wherein the contact surface has a curved surface, and the inclined piston surface has the same radius of curvature as the contact surface.

* * * * *